US005944645A

United States Patent [19]

Kobayashi

[11] Patent Number: 5,944,645

[45] Date of Patent: Aug. 31, 1999

[54] FINISHER

[75] Inventor: Tadashi Kobayashi, Toyokawa, Japan

[73] Assignee: Minolta Co., Ltd., Osaka, Japan

[21] Appl. No.: 08/949,060

[22] Filed: Oct. 10, 1997

[30] Foreign Application Priority Data

Mar. 12, 1997 [JP] Japan ..... 9-058124

[51] Int. Cl.[6] ..... B31B 1/00; B31B 49/00

[52] U.S. Cl. ..... 493/16; 493/31; 493/33; 271/256; 271/258.01

[58] Field of Search ..... 271/256, 258.01, 271/259, 261, 298, 302, 303, 304; 493/16, 31, 34, 33; 270/58.03

[56] References Cited

U.S. PATENT DOCUMENTS

| | | | |
|---|---|---|---|
| 4,231,567 | 11/1980 | Ziehm | 271/259 |
| 4,469,323 | 9/1984 | Miyashita et al. | 271/288 |
| 4,474,454 | 10/1984 | Sugiura | 355/14 |
| 4,586,813 | 5/1986 | Ide | 355/50 |
| 4,737,820 | 4/1988 | Murray | 355/14 |
| 4,878,087 | 10/1989 | Sakai et al. | 355/207 |
| 4,973,041 | 11/1990 | Yamasaki | 271/288 |
| 5,032,876 | 7/1991 | Murakami | 355/324 |
| 5,067,305 | 11/1991 | Baker et al. | 493/16 |
| 5,137,270 | 8/1992 | Sloan et al. | 271/272 |
| 5,322,274 | 6/1994 | Takahashi et al. | 271/258 |
| 5,344,130 | 9/1994 | Suzuki et al. | 270/53 |
| 5,382,011 | 1/1995 | Tani | 270/37 |

*Primary Examiner*—James F. Coan
*Assistant Examiner*—Gene L. Kim
*Attorney, Agent, or Firm*—Sidley & Austin

[57] ABSTRACT

A finisher includes moving devices, which are movably mounted relative to a conveying path for applying additional-workings to a sheet having an image formed surface, such as a folding stopper which adjusts the position for folding the sheet, an aligning device which aligns the edge of sheet being temporarily stacked, and a head unit of a stapler which staples the sheet at a proper position. The finisher retracts or returns the moving devices to their relevant home positions, which are separated by prescribed distances from the conveying path when a jam of a sheet occurs. Accordingly, the finisher forms a space which accepts a user's hand in the neighborhood of the stuck sheet, improves the operational efficiency of removing the sheet, and prevents the user from touching the moving devices and inevitably moving them to abnormal positions.

26 Claims, 20 Drawing Sheets

NORMAL STAPLE MODE

FOLD STAPLE MODE

Z-FOLDING

DOUBLE-FOLDING

CREASING MODE

MIXED STAPLE MODE

UNFOLDED AND Z-FOLDING

FINISHER

BACKGROUND OF THE INVENTION

1. Field of the Invention

This invention relates to a finisher, which is connected to an image forming apparatus such as a printer or a copying machine, applying such additional-workings assorting, binding, creasing, folding, and punching to a recording medium (hereinafter referred to briefly as "sheet") such as a recording paper outputted from the image forming apparatus.

2. Description of the Related Art

Recently, various finishers, which apply various additional-workings to a sheet with an image formed surface which are outputted from such image forming devices as printers and copying machines, have been proposed (U.S. patent application Ser. No. 08/821,444). The term "additional-workings" as used herein means various working processes such as sorting sheets according to the number of copies, filing sheets with staples, folding sheets in two (hereinafter referred to as "double-folding"), folding sheets in three or in a cross section like a letter Z (hereinafter referred to as "Z-folding"), and punching sheets for filing.

The finisher drives a folding stopper to contact with the leading end of an incoming sheet to form a loop of the sheet, and a pair of folding rollers nips the loop to fold the sheet. The finisher drives a plurality of such folding stoppers to move into or out of relevant conveying paths, or a lone folding stopper to move in the conveying direction, depending on the sheet size and the folding mode, in order to decide the folding position.

The finisher is provided with aligning devices, which are movable in the conveying direction and in the direction perpendicular thereto, for aligning the edge of a sheet when a plurality of sheets having an image formed surface are stacked in preparation for the additional-workings. Further, the finisher is provided with a stapler which staples a sheaf of the aligned sheets. The stapler includes a head unit and the like, which are movable for stapling the sheaf at a proper position.

The conventional finisher, when a sheet is stuck inside, or a jam occurs, removes the stuck sheet as a procedure of restoration from the jam, then returns such moving devices as the folding stoppers, the aligning device, and the head unit of the stapler temporarily to their home positions serving as bases, and moves them to their inceptive positions prior to the occurrence of the jam.

The conventional finisher has a problem that the removal of the stuck sheet as the restoring procedure from the jam is possibly difficult or not satisfactory when the finisher is miniaturized and the moving devices happen to be located inside or close to the conveying path. Further, the finisher has a problem of possibly touching a user to touch the moving devices and inevitably moving them from their normal positions.

SUMMARY OF THE INVENTION

It is an object of this invention to provide a finisher which has good operational efficiency of restoration from a failure such as the occurrence of the jam in the interior, and secures accurate positions for such moving devices as the folding stopper, the aligning device, and the head unit of the stapler which are used for the various additional-workings given to sheets.

To accomplish the object described above, this invention provides a finisher, which is connected to an image forming apparatus and applies various additional-workings to a sheet having an image formed surface outputted from the image forming apparatus, comprising a moving device which is movably mounted relative to a conveying path for giving an additional-working to the sheet, and a sensor which detects the moving device at a home position, which is separated by a prescribed distance from the conveying path, as a basis for controlling a position for the moving device, wherein the moving device, when a failure occurs inside, is returned to the home position prior to a procedure of restoration from the failure. The finisher returns the moving device to the home position separated by a prescribed distance from the conveying path when the sheet is stuck in the interior, or the jam occurs. In other words, the finisher retracts the moving device in a direction away from the conveying path so that the moving device is no longer positioned inside or close to the conveying path. It results in the formation of a space for accepting a user's hand in the neighborhood of the sheet. Accordingly, the user can insert his hand easily in the neighborhood of the sheet and remove this sheet, and has no possibility of occurring the inconvenience wherein the user accidentally touches the moving device and inevitably moves it to an abnormal position while trying to remove the sheet. Namely, the finisher can secure accurate positions for the moving device and requires no additional mechanism, and the moving device can have only a strength because there is no possibility of the user accidentally touching the moving device, thus providing a simplification of the structure and a reduction in cost.

This invention also concerns a finisher, which is connected to an image forming apparatus and applies various additional-workings to a sheet having an image formed surface outputted from the image forming apparatus, comprising a moving device which is mounted movably relative to a conveying path for applying an additional-working to the sheet, and a sensor which detects the moving device at a home position, which is separated by a prescribed distance from the conveying path, as a basis for controlling a position for the moving device, wherein the moving device, when a failure occurs in the image forming apparatus, is returned to the home position prior to a procedure of restoration from the failure.

This invention further concerns a method for a restoration from a failure of device, which comprises a step of detecting a failure of device, a step of returning a moving device to a home position after the failure is detected, and a step of outputting a message that a failure occurs, when it is detected that the moving device is returned to the home position.

The objects, characteristics, and advantages of this invention other than those set forth above will become apparent from the following detailed description of the preferred embodiments which makes reference to the annexed drawings.

DETAILED DESCRIPTION OF THE INVENTION

The preferred embodiments of this invention will be described below with reference to the accompanying drawings.

Figure 1:
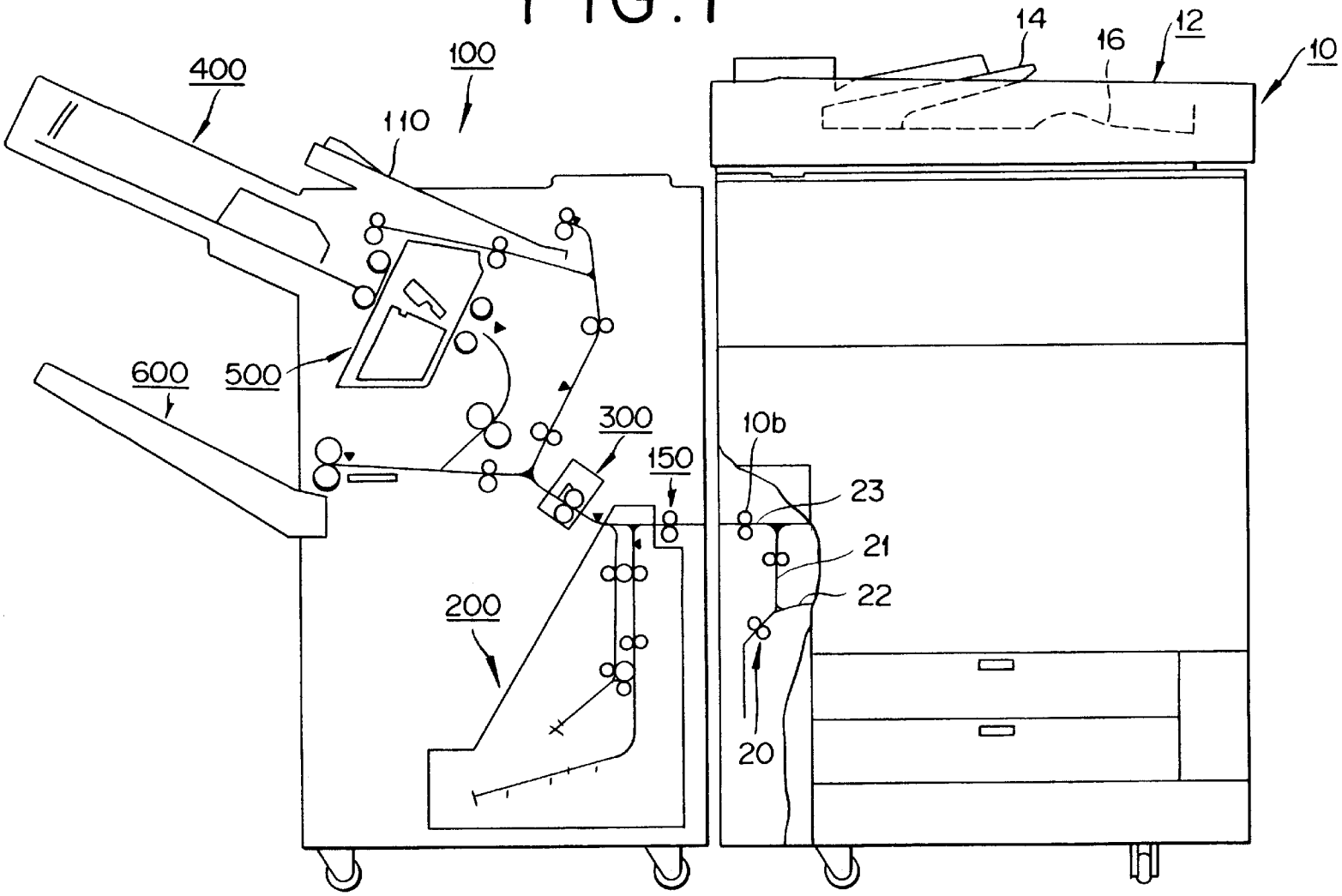
FIG. 1 is cross-sectional view of an embodiment having a finisher according to this invention connected to a copying machine as an image forming device.
Figure 2:
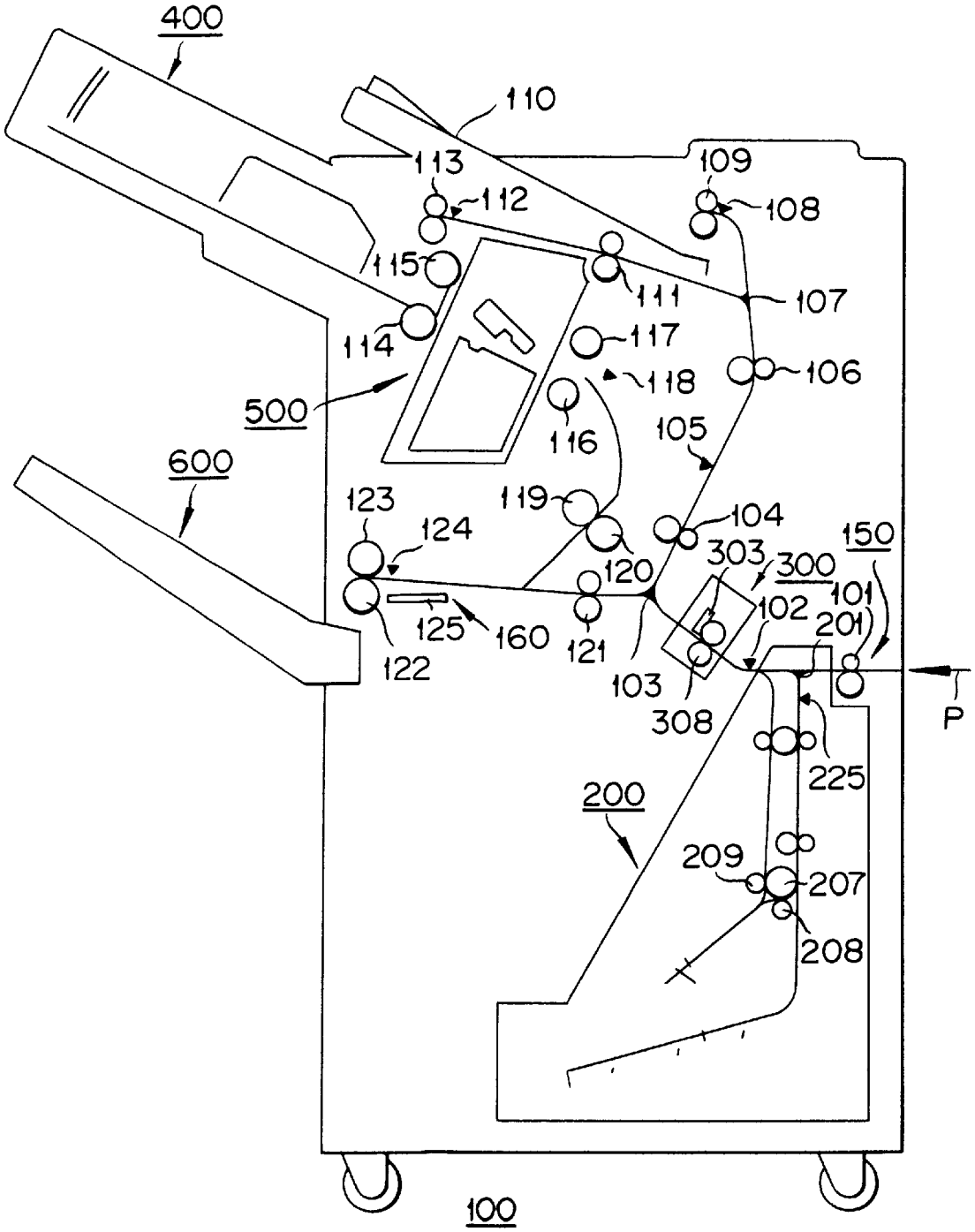
FIG. 2 is a cross-sectional view of the essential section of the finisher.

FIG. 1 is a cross-sectional view of an embodiment having a finisher 100 according to this invention connected to a copying machine 10 as an image forming device and FIG. 2 is a cross-sectional view of the essential section of the finisher 100.

In this specification, the direction of conveyance of a sheet will be referred to as "conveying direction" and the direction perpendicular to the conveying direction as "orthogonal direction." Then, the orientations of a sheet are defined as follows relative to the conveying direction. The orientation of the sheet whose longitudinal direction falls along the conveying direction will be referred to as "longitudinal" and the orientation of the sheet whose longitudinal direction perpendicularly crosses the conveying direction as "lateral."

The illustrated copying machine 10 to which the finisher 100 is connected is a digital copying machine. The digital copying machine reads and temporarily stores in a memory an image on the surface of a document and, when necessary, executes various image processings. Then, it forms the image on a sheet by the well-known electrophotographic method and outputs sheets with the copied image one by one from a sheet output section 10*b*.

The copying machine 10 has an automatic document feeder 12 (hereinafter referred to as "ADF") on the upper section. The ADF 12 feeds one document or a plurality of documents (group of documents) set on a tray 14 one by one onto a platen glass (not shown) of the copying machine 10 and, after scanning the image, outputs and stacks the document onto a tray 16.

The copying machine 10 of the present embodiment is a so-called first page system which starts a copying motion from the first page onward of the group of documents on the tray 14 of the ADF 12, the group of documents are set, with the first page turned upward. The copying machine of the first page system obviates the necessity for inputting or detecting the number, odd or even, of the documents in the group as when an image on one side of the document is copied on the obverse and reverse sides of one sheet. It produces advantages such as a quick copying motion.

As the document is set on the platen glass by the ADF 12, the image on the document is read by an image reader (not shown) built in the copying machine 10, converted into digital data, and stored in a memory of the control unit. The copying operation, after read out of the image data, is executed as combined with such necessary editorial processings as, for example, changing the order of pages, inverting an image, or producing copied images on both sides of a sheet.

This copying machine 10 is provided near the sheet output section 10*b* with a turn-back mechanism 20 for turning a sheet with copied image upside down. This mechanism will be described more specifically herein below.

The finisher 100 of the present embodiment performs, either selectively or as suitably combined, such folding work as folding the sheets outputted from the sheet output section 10*b* of the copying machine 10 and conveyed one by one, in two or three (Z-folding in a cross section like a letter Z) as occasion demands, a punching work for forming holes for filing in the edges of the sheets, and a stapling for binding a sheaf with staples. Further, in this finisher 100 the mode of conveyance of sheets, the mode of stacking of sheets, or the mode of folding of sheets are designed on the assumption that it will be used as connected to the copying machine or a printer as an image forming device of the first page system.

The finisher 100, as illustrated in FIG. 2, comprises a feed channel section 150 through which a sheet P outputted from the sheet output section 10*b* is fed, a folding device 200 which folds or creases the sheets conveyed one by one, a punching device 300 which forms holes for filing in the sheets P conveyed one by one, an additional-work tray unit 400 which stacks and aligns the sheets before a stapling work, a stapler 500 disposed on the downstream side of the additional-work tray unit 400 for stapling a sheaf of stacked and aligned sheets, an accumulating tray unit 600 which is capable of receiving a stapled sheaf or an unstapled sheet, and an output tray unit 110 which receives the sheets outputted from the finisher 100.

The feed channel section 150 is provided with a conveying roller 101 and a guide plate. The folding device 200 is provided with a plurality of folding rollers 207, 208, and 209 and is adapted to nip a sheet P between the folding rollers 207, 208, and 209 and folds or creases the sheet P. The stapler 500 is so constructed as to be moved in the two directions, i.e. the conveying direction and the orthogonal direction of the sheaf stacked and aligned in the additional-work tray unit 400.

For the purpose of conveying the sheet to various sections in the finisher 100, conveying rollers 104, 106, 111, and 121 are disposed along the sheet conveying paths. For the purpose of conveying the sheaf, sheaf-conveying rollers 114 and 115, 116 and 117, and 119 and 120 are disposed along the conveying paths of the sheaf. A discharge roller 109 for discharging the sheet P into the output tray unit 110, a discharge roller 113 for discharging the sheet P into the additional-work tray unit 400, and discharge rollers 122 and 123 for discharging the sheet P or the sheaf into the accumulating tray unit 600 are respectively disposed at the terminal positions of the conveying paths.

For the purpose of changing the destination of the sheet being conveyed, a plurality of switch claws 201, 103 and 107 are disposed on the sheet conveying paths. The switch claw 201, which is disposed between the feed channel section 150 and the folding device 200, decides whether or not the sheet P is fed into the folding device 200. The punching device 300 is disposed on the downstream side of the switch claw 201 and is enabled to punch the sheet conveyed from the feed channel section 150 or the sheet conveyed from the folding device 200. The punching device 300 is provided with a punch blade 303 and a resist roller 308 for determining a punching position. The switch claw 103 disposed on the downstream side of the punching device 300 decides whether the sheet P is conveyed to the output tray unit 110 or to the additional-work tray unit 400 or the sheet P is directly conveyed to the accumulating tray unit 600. The switch claw 107 disposed on the downstream side of the switch claw 103 decides whether the sheet P is conveyed to the output tray unit 110 or to the additional-work tray unit 400.

For the purpose of timing the driving or stopping the various components in the finisher 100, a plurality of sensors 102, 105, 108, 112, 118, 124 and 225 for detecting the sheet are disposed on the sheet and sheaf conveying paths.

The finisher 100 of the present embodiment is further provided with a guide unit 160 for preventing the sheaf bound by stapling like a weekly magazine from being defectively discharged into the accumulating tray unit 600. The guide unit 160 illustrated in the diagram is composed of an auxiliary guide 125 which supports the lower side of the sheaf discharged from a space between discharge rollers 122 and 123, and is allowed freely to advance and retract. This construction permits the leading end of the sheaf being discharged to fall toward the downstream side along the discharging direction further than the peak of the preciously discharged center bound sheaf even when the sheaves of sheets are stacked such that the bound sections project upward like a mountain. It results in precluding the possibility of the leading ends of the successively discharged sheaves being caught in the neighborhood of the peaks of the already stacked sheaves.

The finisher 100 is capable of performing a plurality of additional-workings (folding, punching and stapling) on the sheets. The user of the finisher 100 may select freely these works by the use of a control panel of the copying machine 10.

When the user selects a mode excluding a stapling, the sheet P discharged from the sheet output section 10*b* of the copying machine 10 is worked by the folding device 200 and the punching device 300 in response to instructions of the user and conveyed by means of rollers to the output tray unit 110 or the accumulating tray unit 600 for storage.

When the user selects a mode including a stapling, first the sheet P is worked by the folding device 200 and the punching device 300 in response to instructions of the user similar to the mode excluding stapling. Then, a certain number of sheets P which have been folded and/or punched are conveyed to the additional-work tray unit 400 and sequentially stacked and aligned. Thereafter, the sheets which have been stacked and aligned are fed as one sheaf by rollers to the stapler 500.

After the stapler 500 has bound the sheaf by driving staples into the sheaf at the positions selected by the user, the stapled sheaf is conveyed by the rollers to the accumulating tray unit 600 and is stored.

In this finisher 100, the folding device 200 and the punching device 300 (as means for working the incoming sheets one by one) are disposed on the upstream sides of the position of the switch claw 103, or on the upstream sides of the branching points of the conveying paths to a plurality of receiving tray units (referring collectively to the output tray unit 110, the additional-work tray unit 400, and the accumulating tray unit 600). The sheets which have undergone the works (folding and punching in this embodiment) one by one, therefore, can be discharged to any of the receiving tray units.

The main mechanisms of the finisher 100 will be sequentially described in detail below.

Figure 3:
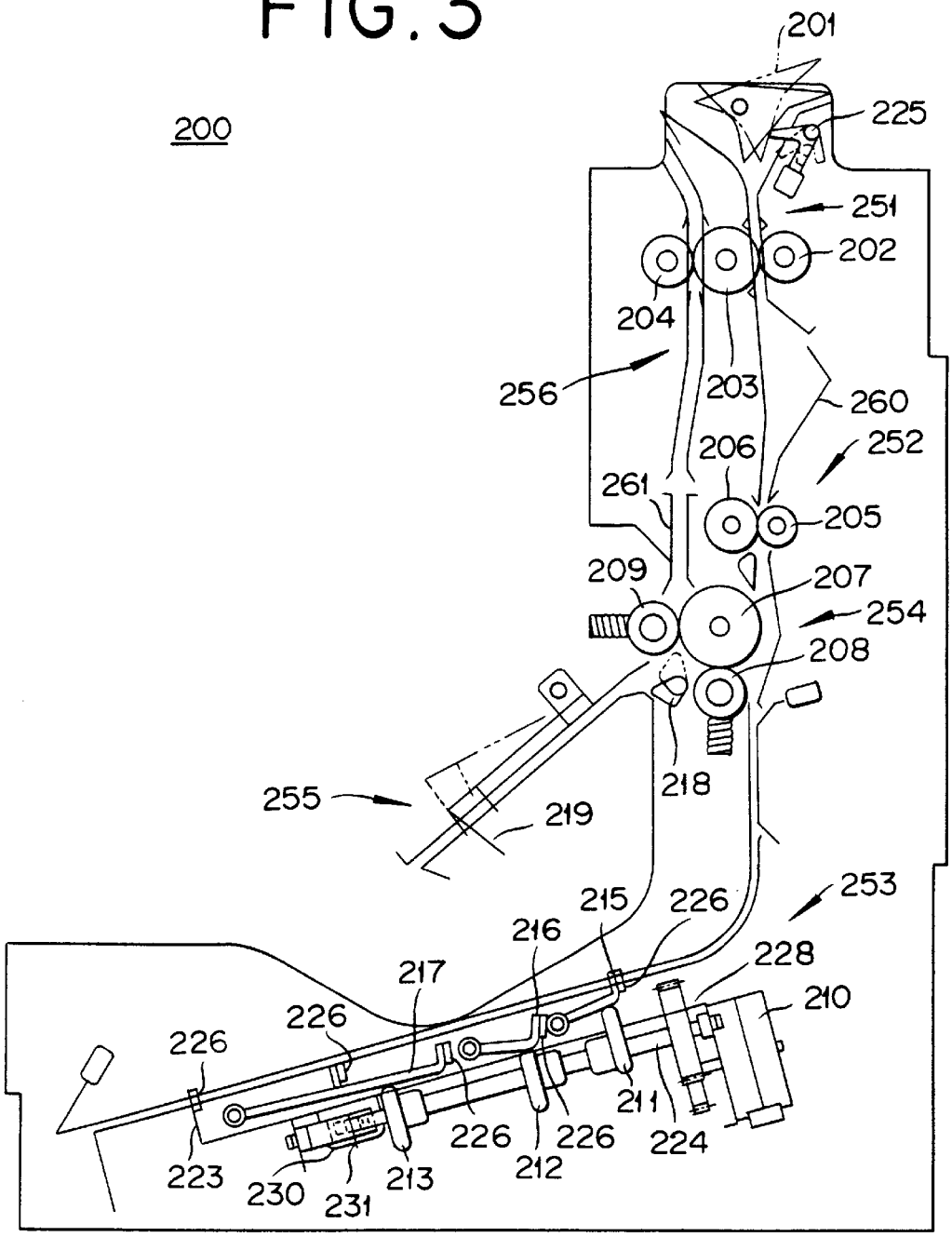
FIG. 3 is a cross-sectional view of the construction of a folding device.
Figure 4:
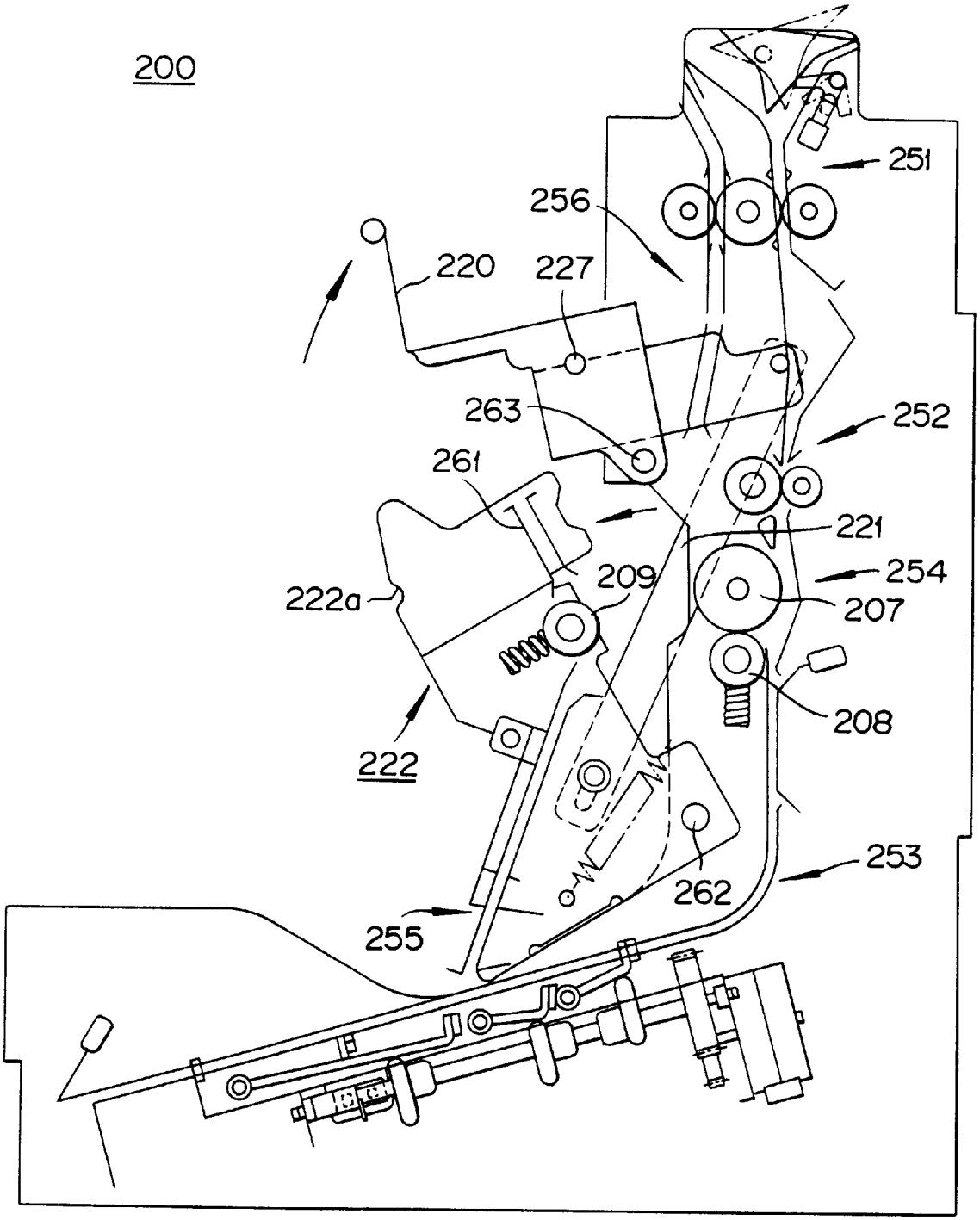
FIG. 4 is a cross-sectional view of the folding device which is jammed.
Figure 5A:
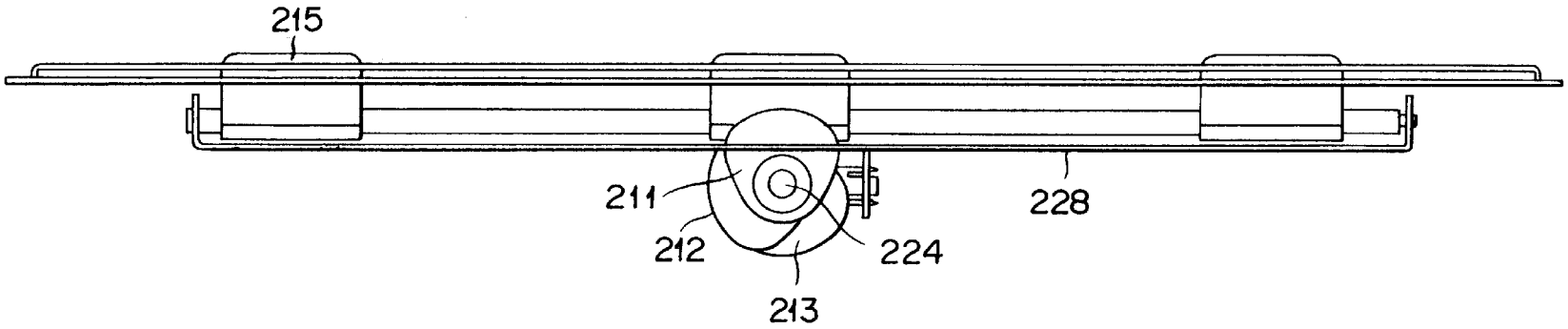
Fig. 5A and FIG. 5B are cross-sectional view of the essential section of a mechanism for regulating the first folding position in the folding device.
Figure 5B:
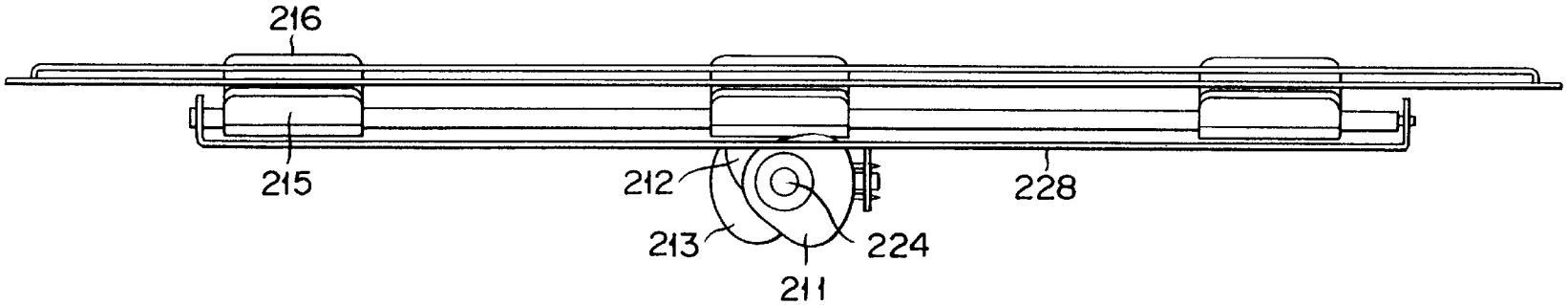
Figure 6:
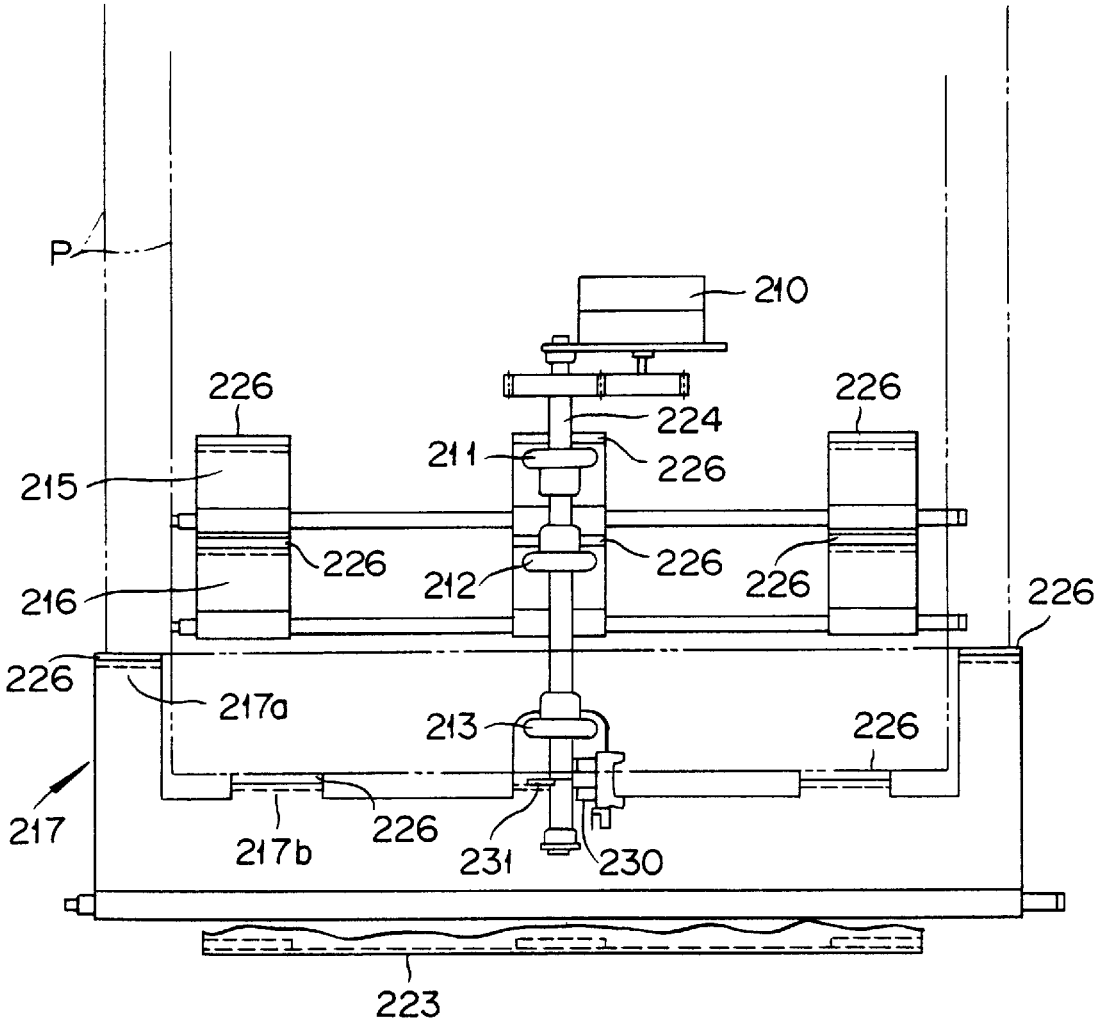
FIG. 6 is a bottom view of the mechanism for regulating the first folding position in the folding device.
Figure 7:
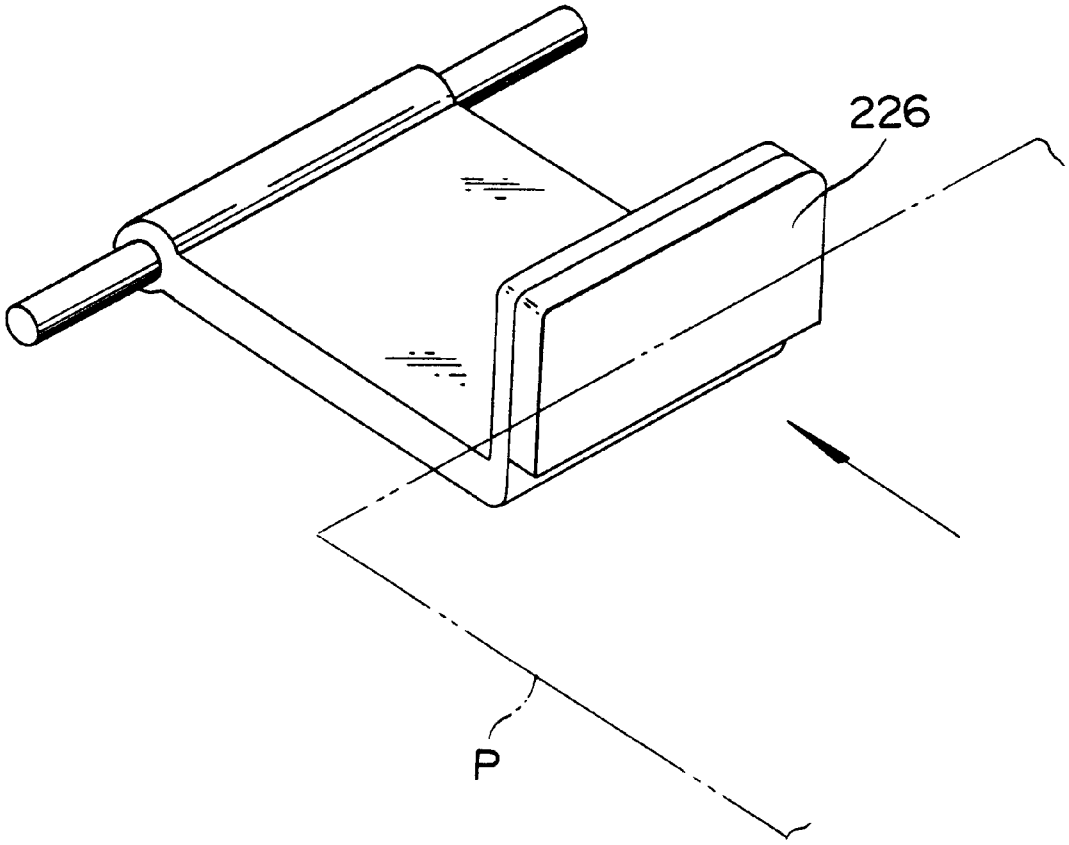
FIG. 7 is a perspective view of the essential section of a first folding stopper.

FIG. 3 is a cross-sectional view of the construction of the folding device 200; FIG. 4 is a cross section view of the folding device 200 which is jammed; FIGS. 5A and 5B and FIG. 6 are respectively cross-sectional views and a bottom view illustrating the essential section of a mechanism for regulating a first folding position in the folding device 200; FIG. 7 is a perspective view illustrating the essential section of a first folding stopper.

The folding device 200 is built in the finisher 100 so as to be drawn out toward the front side of the finisher 100 (the foreground side of FIG. 1) and is supported as mounted to a rail (not shown) extended in the longitudinal direction of the finisher 100.

The folding device 200, as illustrated in FIG. 3, is composed of a feed channel section 251 for inside feeding a sheet for folding, a adjusting section 252 for correcting the sheet fed into the folding device 200 by removing a deviation, a first conveying section 253 for regulating the first folding position of the sheet conveyed from the adjusting section 252, a folding section 254 for creasing or folding the sheet, a second conveying section 255 for regulating the second folding position, and a discharging section 256 for conveying the folded sheet from the folding device 200 to the punching device 300.

The feed channel section 251 comprises the switch claw 201 which selectively guides the sheet to the folding device 200; conveying rollers 202, 203 which convey the sheet fed into the folding device 200, a solenoid (not shown) which rotates the switch claw 201, and a sheet sensor 225 which detects the sheet fed into the folding device 200.

The adjusting section 252 comprises resist rollers 205, 206 disposed on the downstream side of the feed channel section 251, a drive motor (not shown) which drives the resist rollers 205, 206 for folding a sheet, and a solenoid clutch (not shown) which selectively cuts the connection of the motor to the resist rollers 205, 206. The resist rollers 205, 206 are a pair of rollers composed of straight rollers. The surface friction coefficient $\mu$ of the roller 205 is set at a level lower than that of the other roller 206. A guide 260 which is disposed on the upstream side of the resist rollers 205, 206 is shaped such that the leading end of the sheet is made to contact infallibly to the roller 205 having a lower surface friction coefficient.

The procedure for correcting a deviated sheet is as follows.

First, the sheet sensor 225 detects the leading end of an incoming-sheet. At this time, the solenoid clutch is in the OFF state and the driving force of the motor for sheet folding is not transmitted to the resist rollers 205, 206.

Then, after the elapse of the time (t+t1) [in seconds], the solenoid clutch is turned on to transmit the driving force to the resist rollers 205, 206 to convey the sheet to the downstream side. Here, the letter "t" refers to the time [in seconds] required for the leading end of a given sheet to reach the nip part of the resist rollers 205, 206.

In consequence of the operation, a loop, V×t1 [mm] (in which V stands for the sheet conveying speed [mm/second]) in length, is formed on the sheet between the conveying rollers 202, 203 and the resist rollers 205, 206. Owing to the formation of this loop, the leading end of the sheet is caused by the intensity of the nerve of the sheet to conform to the contour of the nip part and the deviation of the sheet is adjusted.

The first conveying section 253 disposed on the downstream side of the adjusting section 252 comprises first folding stoppers 215, 216, 217 and 223 which move into and out of the sheet conveying paths in accordance with the sheet size and the folding form and regulate the first folding position of the sheet by contacting to the leading end of the sheet, cams 211, 212 and 213 which actuate the first folding stoppers 215, 216 and 217, a stepping motor 210 which rotates the cams 211, 212 and 213, and anti-deviation devices 226 of an elastic material which are disposed where the first folding stoppers 215, 216, 217 and 223 are come with the leading end of the sheet.

The first folding stoppers 215, 216, 217 and 223 will be described more specifically herein below. The first folding stopper 217 especially has the function of regulating the first folding position for sheets of two kinds with one stopper.

The three cams 211, 212 and 213 are fixed to a cam shaft 224 as shifted in angle such that the three first folding stoppers 215, 216 and 217 are each moved in and out of the sheet conveying path just once each time the cam shaft 224 produces one complete rotation.

The folding section 254 disposed between the downstream positions of the resist rollers 205, 206 and the upstream position of the first folding stopper 215 has the three folding rollers 207, 208 and 209. These folding rollers 207, 208 and 209 have a straight shape.

The folding rollers 208 and 209 are each pressed against the folding roller 207. Namely, the folding rollers 207, 208 and the folding rollers 207, 209 are respectively in pairs. The folding rollers 207, 208 which are paired will be referred to hereinafter as "paired folding rollers 207, 208" and the folding rollers 207, 209 as "paired folding rollers 207, 209." The paired folding rollers 207, 208 are disposed such that the nip part continues into the first conveying section 253.

The second conveying section 255 is disposed between the downstream positions of the paired folding rollers 207, 208 and the upstream positions of the paired folding rollers 207, 209. The second conveying section 255 comprises a second folding stopper 219 which regulates the second folding position of the sheet by contacting the leading end of the sheet, a solenoid (not shown) which switches the position of the second folding stopper 219 contacting the sheet in conformity with the sheet size, a switching mechanism 218 which selectively guides the leading end of the sheet which has undergone the first folding by the paired folding rollers 207, 208 in the direction of the nip part of the paired folding rollers 207, 209 or in the direction of the second folding stopper 219, and a solenoid (not shown) which rotates the switching device 218.

The discharging section 256 is disposed on the downstream side of the paired folding rollers 207, 209 and is possessed of discharging rollers 203 and 204. The roller 203 constitutes one of the conveying rollers 202, 203.

In the construction, the discharging section 256 is disposed between the conveying path on the upstream side for conveying the sheet in the direction of the first folding stopper 215 for the sake of the first folding and the conveying path in the second conveying section with the second folding stopper 219. Consequently, the paired folding rollers 207, 209 are disposed at the initial point of the conveying path in the discharging section 256. The folding roller 207 which is used commonly by the two pairs of folding rollers is disposed on the upstream side in the conveying direction of the sheet during the first folding.

The mechanism of restoring from a sheet jam which occurs in the folding section 254 of the folding device 200 will be described with reference to FIG. 4.

The folding rollers 207, 208 and 209 in the folding section 254 have relatively high pressing force because they are required to fold the sheet strongly. The pressing force, for example, is 10 kg per roller. When the sheet happens to be wrapped tightly around any of the folding rollers 207, 208 and 209, it is a very difficult to remove the stuck sheet or solve the jam.

The folding device 200 of the present embodiment, therefore, releases either of the two folding rollers 208, 209 from being pressed against the folding roller 207 and opens the folding section 254 in order to improve the operational efficiency of restoring from the jam in the vicinities of the folding rollers 207, 208 and 209. This construction will be described below.

An open unit 222 is formed by integrally retaining the second conveying section 255, the single folding roller 209 and a guide 261 of the discharging section 256. This open unit 222 is supported as being freely rotated around a fulcrum 262 provided on a frame of the folding device 200.

Further, a lock lever 220 constructed to encircle the periphery of the most remote section of the open unit 222 from the fulcrum 262 (as the upper end of the diagram) is supported as being freely rotated around a fulcrum 263 provided on the frame. Lock shafts 227 are provided one each in the front and rear portions of the lock lever 220 extending in the direction perpendicular to the face of the sheet bearing an image. When the open unit 222 is closed, the lock shafts 227 are each engaged with recess 22*a* formed in the open unit 222 and the open unit 222 is infallibly locked to the folding device 200.

The lock lever 220 and the open unit 222 are connected through a link device 221. The link device 221 enables the open unit 222 to be retained and rotated as synchronized with the rotation of the lock lever 220 and can preclude the falling of the open unit 222 during opening of the lock.

As illustrated in FIG. 5A, FIG. 5B and FIG. 6, the first folding stoppers 215, 216, 217 and 223 as devices for regulating the leading end of the sheet, the cams 211, 212 and 213, the stepping motor 210, and the cam shaft 224 are integrally held by a stopper unit frame 228.

Except for the stopper 223, which is disposed on the most downstream side in the conveying direction of the sheet, the first folding stoppers 215, 216 and 217 are constructed as being freely rotated around respective fulcrums provided on-the stopper unit frame 228. The first folding stopper 223 is fixed to the stopper unit frame 228 and retained as constantly projected into the sheet conveying path.

The first folding stoppers 215, 216 and 217 are driven to move into and out of the sheet conveying path by the rotation of the cams 211, 212 and 213 and the cam shaft 224 which are disposed on the lower side of the frame 228. The cams 211, 212 and 213 are attached at different angles to the cam shaft 224. The first stoppers 215, 216 and 217 each move into and out of the sheet conveying path while the cam shaft 224 produces one complete rotation. The stepping motor 210 rotationally drives the cam shaft 224. One of the first folding stoppers 215, 216 and 217 is moved into and out of the sheet conveying path by actuating the stepping motor 210 in a desired angle proper for the folding mode or the sheet size.

The cam shaft 224 is provided with a light stop or gobo 231. The gobo 231 is moved into and out of the detecting area of a home position sensor 230 in consequence of the rotation of the cam shaft 224. The position at which the home position sensor 230 detects the gobo 231 is the home position for the cam shaft 224. At the home position, all of the first folding stoppers 215, 216 and 217 that are capable of moving into and out of the sheet conveying path are not in a projecting state except the first folding stopper 223.

The first folding stopper 217 is designed to have the function of regulating two kinds of folding positions. To be specific, it is approximately shaped like a letter U having the opposite ends projected toward the upstream side in the conveying direction of the sheet as clearly shown in FIG. 6. This shape is applicable only when the position for regulating the leading end of a sheet of a small width relative to the orthogonal direction falls on the downstream side in the conveying direction from the position for regulating the leading end of a sheet of a large width. Naturally, in this case, the stopper for the sheet of a large width must be disposed on the outer side along the orthogonal direction than the stopper for the sheet of a small width. In other words, the first folding stopper 217 is required to form, at the upstream position in the conveying direction, a notch of a width larger than the width of that of the two kinds of sheets which has a smaller width. The edges of the notch, or the edge located on the upstream side in the conveying direction and the edge located on the bottom, function as stoppers which come in contact with the leading edges of the two different kinds of sheets, respectively In the illustrated embodiment, the first folding stopper 217 is constructed by integrating stoppers 217*a* disposed on the opposite outer sides used in double-folding of an A3 sheet with a stopper 217*b* disposed on the further downstream side than the stopper 217*a* and used in Z-folding of a B4 sheet.

The anti-deviation device 226 is mounted where the first folding stoppers 215, 216, 217 and 223 come in contact with the leading end of the sheet as illustrated in FIG. 7. The anti-deviation device 226 is provided for the purpose of precluding the inconvenience that the leading end of the sheet slides laterally on the contacting face of a stopper and induces deviation of the folding position. This fact explains why the anti-deviation device 226 is made of an elastic material with a high surface friction coefficient and a low hardness. The anti-deviation device 226 is also effective in abating the noise which is made when the leading end of the sheet comes in contact with the stopper.

The advantages of the construction are as follows.

Firstly, the deviation of positions occurring when the leading end of a sheet is regulated is slight, because the devices for regulating the leading end of a sheet, or stoppers 215, 216, 217 and 223 are disposed one each at the plurality of positions used or required for regulating the leading end of a sheet.

Secondly, one motor 210 suffices as a drive source, because the plurality of devices for regulating the leading end of a sheet can be actuated by the single cam shaft.

Thirdly, the components for actuation can be simplified, because a device for regulating the leading end of a sheet, or stopper 217 has the function of regulating the leading ends of two kinds of sheet and a device for regulating the leading end of a sheet on the most downstream side, or stopper 223 has a stationary structure. Namely, the function of regulating the leading end of a sheet can be accomplished with high accuracy by means of simple and inexpensive construction.

It is, when necessary, allowable to divide the drive system into two and add the cam shafts, etc. though one cam shaft and one motor suffice to actuate the plurality of devices for regulating the leading end of a sheet.

The folding device 200 has the three folding modes, (1) Z-folding, (2) double-folding, and (3) creasing. When the folding mode is inputted through a control panel provided in the copying machine 10, the folding device 200 is controlled in the inputted mode.

Figure 8:
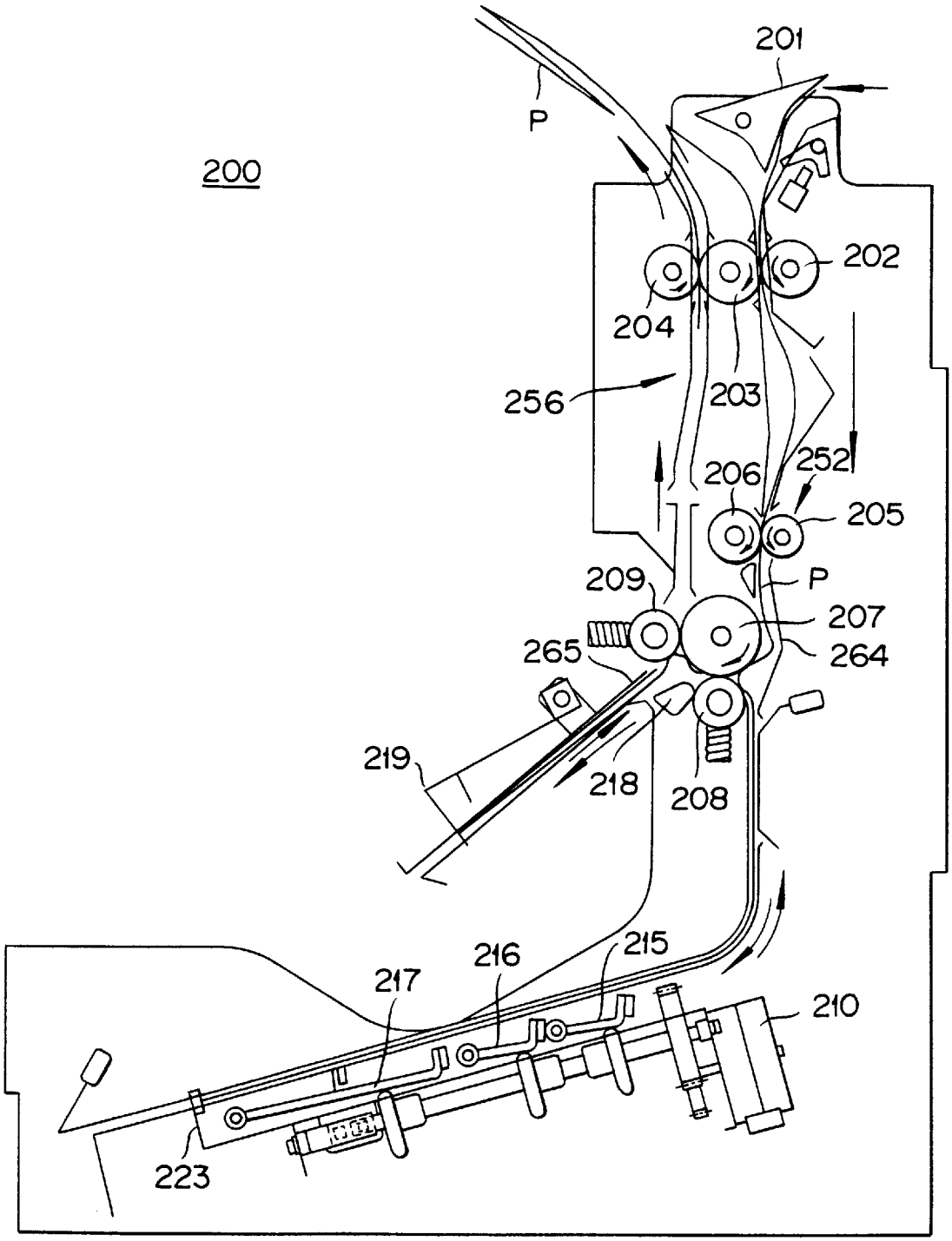
FIG. 8 is a cross-sectional view of the state of the folding device under the A3 Z-folding mode.

FIG. 8 is a cross-sectional view illustrating the state of the folding device 200 under the A3 Z-folding mode. In the diagram, the states which the sheet P assumes at different points of time are simultaneously indicated in the folding device 200 as well as in FIGS. 9. and 10.

The term "Z-folding mode" refers to a mode of folding a sheet of a large size (A3 or B4 ) in a cross section like a letter Z, or in the sheet in a size approximately one half of the original length of the sheet along the conveying direction.

The sheet P outputted from the sheet output section 10*b* of the copying machine 10 is conveyed in the "longitudinal" direction to the switch claw 201, with the image-formed face held on the upper side. The sheet P is fed into the folding device 200 by the rotation of the switch claw 201 and then nipped by the conveying rollers 202, 203. The sheet P is further conveyed to the adjusting section 252 wherein the leading end of the sheet is corrected by removal of a deviation. Thereafter, the sheet P is conveyed toward the first folding stoppers 215, 216, 217 and 223.

Immediately after the command of a copy start is inputted, the stepping motor 210 is rotated by a fixed number of steps proper for the sheet size and the folding mode to set the position of the first folding stopper 215 216 or 217 (projecting position or retracting position). All the three first folding stoppers 215, 216 and 217 are retracted and the fixed first folding stopper 223 alone is projected when the sheet has the size of A3 and is in the longitudinal direction under the Z-folding mode as illustrated in the diagram. The first folding stopper 217 is moved to the projected position when the sheet has the size of B4 and is in the longitudinal direction.

After the leading end of the sheet has come with the first folding stopper 223, the conveyance of the sheet is further continued. As a result, the sheet forms a loop in the neighborhood of the nip of the paired folding rollers 207, 208 and the loop is finally gripped by the nip of the paired folding rollers 207, 208. Consequently, the first folding is effected on the sheet.

A guide 264 near the nip of the paired folding rollers 207, 208 is naturally constructed in a shape such that the loop in the sheet P is infallibly formed steadily as directed to the nip of the paired folding rollers 207, 208.

The first folding position is separated by approximately ¾ of the total length of the sheet in a given sheet size from the edge of the sheet, or the leading end side in entering the folding device 200. In this specification, for the sake of convenience of description, the first fold will be defined as "three-quarter (¾) fold." The first fold at the position separated by approximately ¼ of the total length of the sheet from the edge of the sheet will be defined as "one-quarter (¼) fold."

In response to the command "Z-folding" from the copying machine 10, the switching device 218 is moved to the position for leading the sheet P in the direction of the second folding stopper 219. The leading end of the sheet P conveyed by the paired folding rollers 207, 208 comes in contact with the second folding stopper 219 which has been switched in accordance with the sheet size.

When the conveyance of the sheet P is continued by the paired folding rollers 207, 208 after the leading end has come with the second stopper 291, the sheet P forms a loop near the nip of the paired folding rollers 207, 209. This loop is finally gripped by the nip of the paired folding rollers 207, 209. The second folding position is at a distance of approximately ½ of the total length of the sheet.

Here again, a guide 265 near the nip of the paired folding rollers 207, 209 is naturally constructed in a shape such that the loop in the sheet P is infallibly formed steadily as directed to the nip of the paired folding rollers 207, 209.

The sheet P on which the Z-folding has been completed by the second folding is conveyed toward the discharging section 256 by the paired folding rollers 207, 209 and discharged from the folding device 200 by the discharging rollers 203, 204.

The Z-folding mode can do a so-called mixed working, i.e. an additional-working on a mixture of folded sheets and unfolded sheets. To be specific, Z-folding mode can achieve the mixed working of A3 Z-folding in the longitudinal direction and unfolded A4 sheets in the lateral direction or the mixed working of B4 Z-folding in the longitudinal direction and unfolded B5 sheets in the lateral direction.

Under the mixed mode, sheets for folding can be fed at a standard interval into the finisher 100 when the sheets follows sheets for no folding into the finisher 100. Conversely, feeding of the sheets for no folding at the standard interval into the finisher 100 possibly causes such inconveniences as disruption of the order of pages or the contact between the sheets when the sheets follow sheets for folding into the finisher 100. The present embodiment, therefore, precludes in the latter case the occurrence of such inconveniences as the disruption of the order of pages by loading a weight on the conveyance of the sheets for no folding and preventing these sheets from entering the finisher 100 until the folded sheets are discharged from the folding device 200.

In consideration of the appearance of the product of the mixed working, the second crease or fold is preferably prevented from jutting out of the unfolded sheets. For this reason, the second folding position preferably deviate slightly from the ½ position of the total length of the sheet toward the edge of the sheet as the leading end side in entering the folding device 200.

Namely, Z-folding is done as follows. A sheet is conveyed as the surface with a formed image opposes to the paired folding rollers 207, 208. The first folding is done at the position separated by approximately three quarters of the total length of the conveying direction from the leading end of the sheet on the side of the first folding stopper 217. And the sheet is conveyed as led by the crease of the first folding. The second folding is done by gripping, with the paired folding rollers 207 and 209, a loop formed in consequence of the contact with the second folding stopper 291. Then, the sheet is conveyed through the conveying path of the discharging section 256 which is disposed between the conveying path in the vicinity of the adjusting section 252 and the conveying path of the second conveying section 255. The conveyance of this mode achieves the discharge of the sheet wherein the sheet is advanced as led by the crease and the folded section of the sheet falls on the side bearing the formed image and is directed downward. Therefore, the sheaf including Z-folding sheets is smoothly stacked without disruption of the order of pages in the first page system. Moreover, the sheets can be received such that the sides for stapling opposite to the folded sections approximate closely to the stapler 500 disposed on the downstream side in the conveying direction of the sheet as will be described herein below.

It, therefore, suffices to do the stapling at the position on the side of the regulating device provided in the conveying-direction of the sheet in the state held in the additional-work tray unit 400. It results in shortening the conveying distance of the sheaf necessary for the stapling, achieving the accurate and stable stapling and reducing the deviation of the sheets during the course of conveyance.

A Z-folding sheet is discharged as led by the crease when the sheet is discharged toward the additional-work tray unit 400 for temporary storage. The sheet is at the most remote position from a sheet discharge outlet 401*a* (FIG. 12) through which the sheet is conveyed again from the additional-work tray unit 400. If the folded section of the sheet is located on the side of the sheet discharging outlet 401*a*, the swell of the folded section will block the sheet discharge outlet 401*a* and the sheet already discharged into the additional-work tray unit 400 will ride over the roller 115 and give rise to disorder. In contrast, the present embodiment can avoid such a detrimental situation because the folded section of the sheet is at the remotest position from the sheet discharging outlet 401*a*.

The folding device 200 including the paired folding rollers 207, 208 and 207, 209 can be constructed so as to be disposed in the lower section of the interior of the finisher even when the first page system is adopted. The finisher, therefore, can be produced in a compact construction avoiding an addition to size and enjoying efficient use of space.

Figure 9:
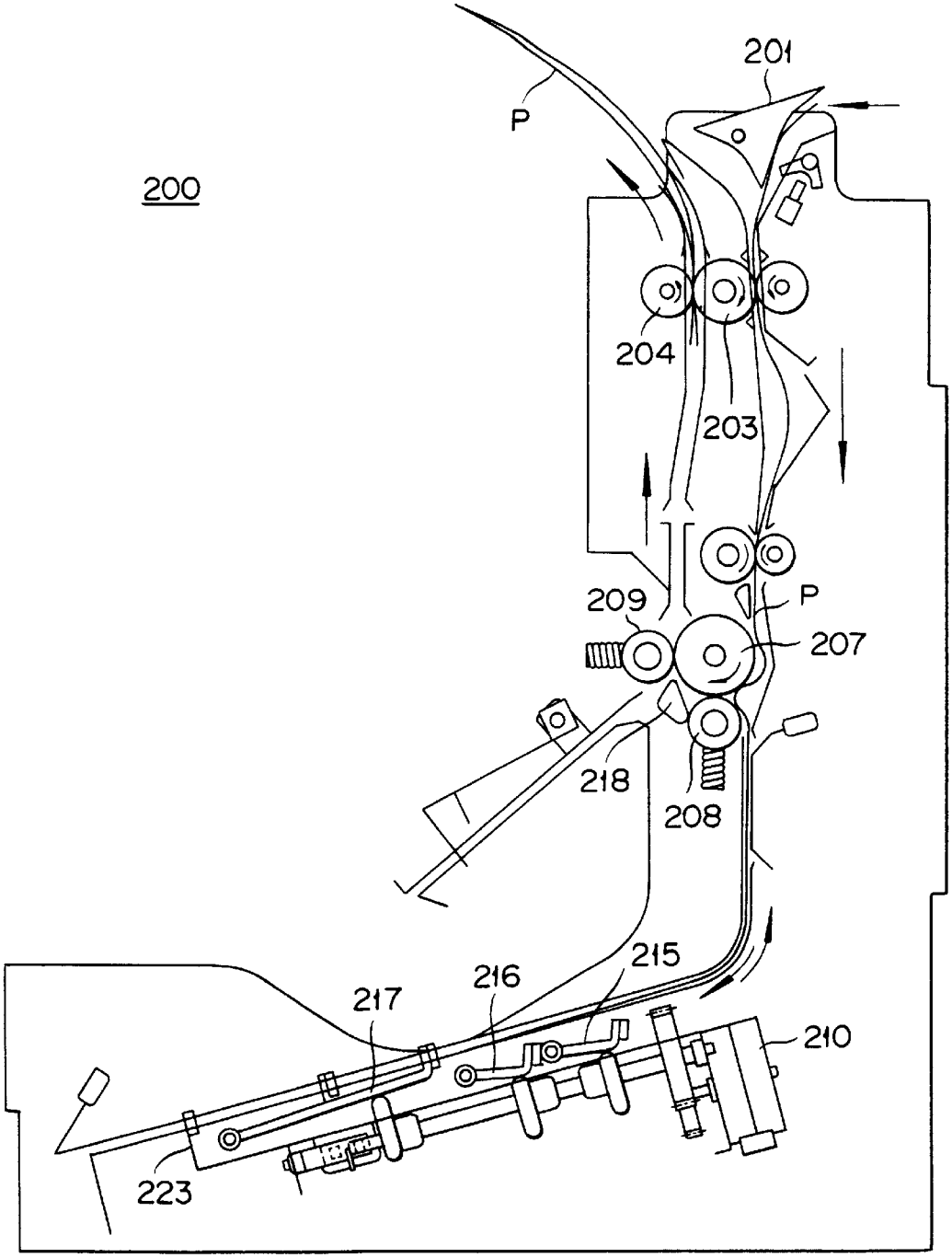
FIG. 9 is a cross-sectional view of illustrating the state of the folding device under the A3 double-folding mode.

FIG. 9 is a cross section illustrating the state of the folding device 200 under the A3 double-folding mode.

The term "double-folding mode" refers to the mode of folding a sheet in two or in the central section.

The sheet P discharged from the sheet output section 10*b* of the copying machine 10 undergoes the same process as under the Z-folding mode and conveyed toward the first folding stoppers 215, 216, 217 and 223.

Likewise under the double-folding mode, the stepping motor 210 is controlled to move only the first folding stopper 217 to the projecting position when the sheet has the size of A3 and is in the longitudinal direction, as illustrated in the diagram. The first folding stopper 216 is only moved to the projecting position when the sheet has the size of B4 and is in the longitudinal direction. The first folding stopper 215 is only moved to the projecting position when the sheet has the size of A4 and is in the longitudinal direction. The sheet P, after undergoing the same process as under the Z-folding mode, is gripped by the nip of the paired folding rollers 207, 208 and then given the first folding.

In response to the command "double-folding" from the copying machine 10, the switching device 218 is moved to the position for guiding the sheet P toward the nip of the paired folding rollers 207, 209. Then, the sheet P conveyed by the paired folding rollers 207, 208 is gripped on the crease by the nip of the paired folding rollers 207, 209 and conveyed per se to the paired discharging rollers 203, 204 and discharged from the folding device 200.

Figure 10:
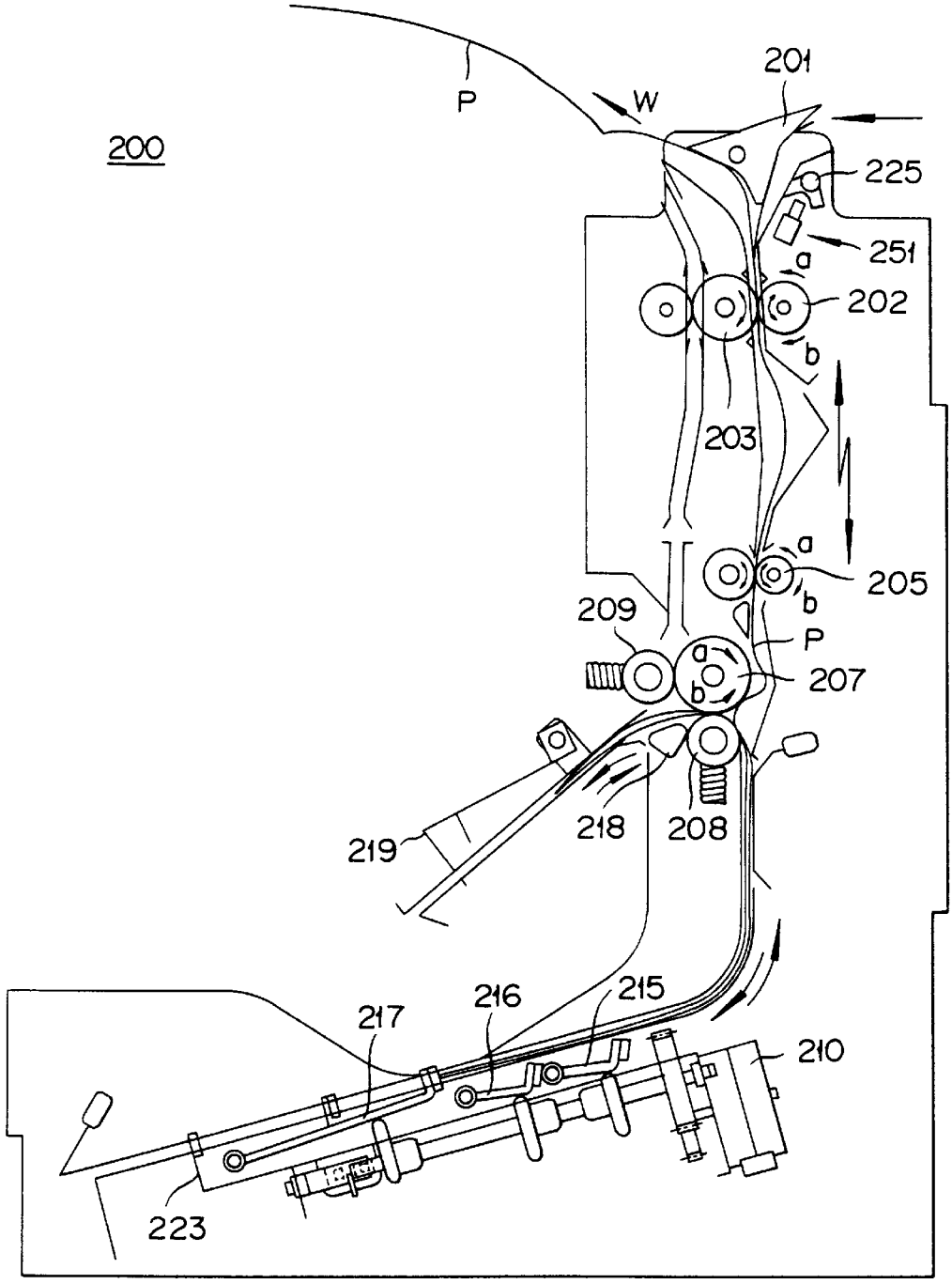
FIG. 10 is a cross-sectional view of the state of the folding device under the creasing mode.

FIG. 10 is a cross-sectional view illustrating the state of the folding device 200 under the creasing mode.

The term "creasing mode" refers to the mode of preparatorily creasing the central section of sheet for stapling the central crease of the sheaf like a weekly magazine.

The sheet P discharged from the sheet output section 10*b* of the copying machine 10 is conveyed toward the first folding stoppers 215, 216, 217 and 223, similarly to the Z-folding mode or the double-folding mode.

The folding position under the creasing mode is identical with that under the double-folding mode. The motions of the first folding stoppers 215, 216 and 217 are controlled in the same manner as under the double-folding mode. And the sheet P is gripped by the nip of the paired folding rollers 207, 208 and given the first folding.

In response to the command "creasing mode" from the copying machine 10, the switching device 218 is moved to the position for guiding the sheet P toward the second folding stopper 219. The sheet P which has undergone the first folding is conveyed by the paired folding rollers 207, 208 toward the second folding stopper 219.

The driving direction of the rollers 202, 205 and 207 in the folding device 200 is switched from the normal rotation (the direction of the arrow a in the diagram) to the reverse rotation (the direction of the arrow b in the diagram) after the elapse of the period of the time t2 [in seconds] which follows the detection of the trailing edge of the sheet P having undergone the first folding by the sheet sensor 225 in the feed channel section 251. The term "t2" refers to the length of time satisfying the following condition:

$$(y/V)>t2>(x/V)$$

in which V stands for the rate of conveyance of a sheet, x for the distance between the sheet sensor 225 and the lower edge of the switch claw 201, and y for the distance between the leading end of the sheet and the second folding stopper 219 after the detection of the trailing end of the sheet and the completion of the first folding.

The crease formed in the central section of the sheet P is released from the paired folding rollers 207, 208 in consequence of the reverse rotation of the rollers 202, 205 and 207. The edge, which has been the trailing edge during the feed of the sheet into the folding device 200, is now the leading edge. And the sheet is led to the switch claw 201 held in the same state as during the feed of the sheet, passed through the path indicated by the arrow W, and discharged from the folding device 200. In this manner, the sheet P with the central crease can be conveyed in an opened posture toward the downstream side.

Incidentally, all the three folding modes are invariably accepted only when the sheet has a length of not less than twice the length of the sheet of the smallest size that is available for conveyance.

A turn-back mechanism 20, which turns a sheet with a copied image upside down, is installed near the sheet output section 10*b* of the copying machine 10. This turn-back mechanism 20 comprises a path for switchback conveyance of a sheet and a pair of reversible rollers provided in the path. The turn-back mechanism promotes compactness of the finisher and reduction in the cost. The arrangement of the turn-back mechanism 20 does not need to be limited to the vicinity of the sheet output section 10*b* of the copying machine 10. This mechanism 20 may be disposed closely to the feed channel section 150 of the finisher 100 instead.

The copying machine 10 further comprises three paths 21, 22 and 23 used as selectively switched. The first path 21 is applied to discharge the sheet turned by the turnback mechanism 20 from the sheet output section 10*b*. The second path 22 is applied to rotate the sheet turned by the turn-back mechanism 20 within the copying machine 10 for two-sided copies or copying an image on the side opposite to the side with the copied image. The third path is applied to directly discharge the sheet from the sheet output section 10*b* without passing the sheet through the turn-back mechanism.

The copying machine 10, based on the operating mode set by the user and the size of the sheet selected for copying, judges whether or not the sheet for copying is subsequently folded and inputs the information resulting from this judgment to the finisher 100.

Figure 11:
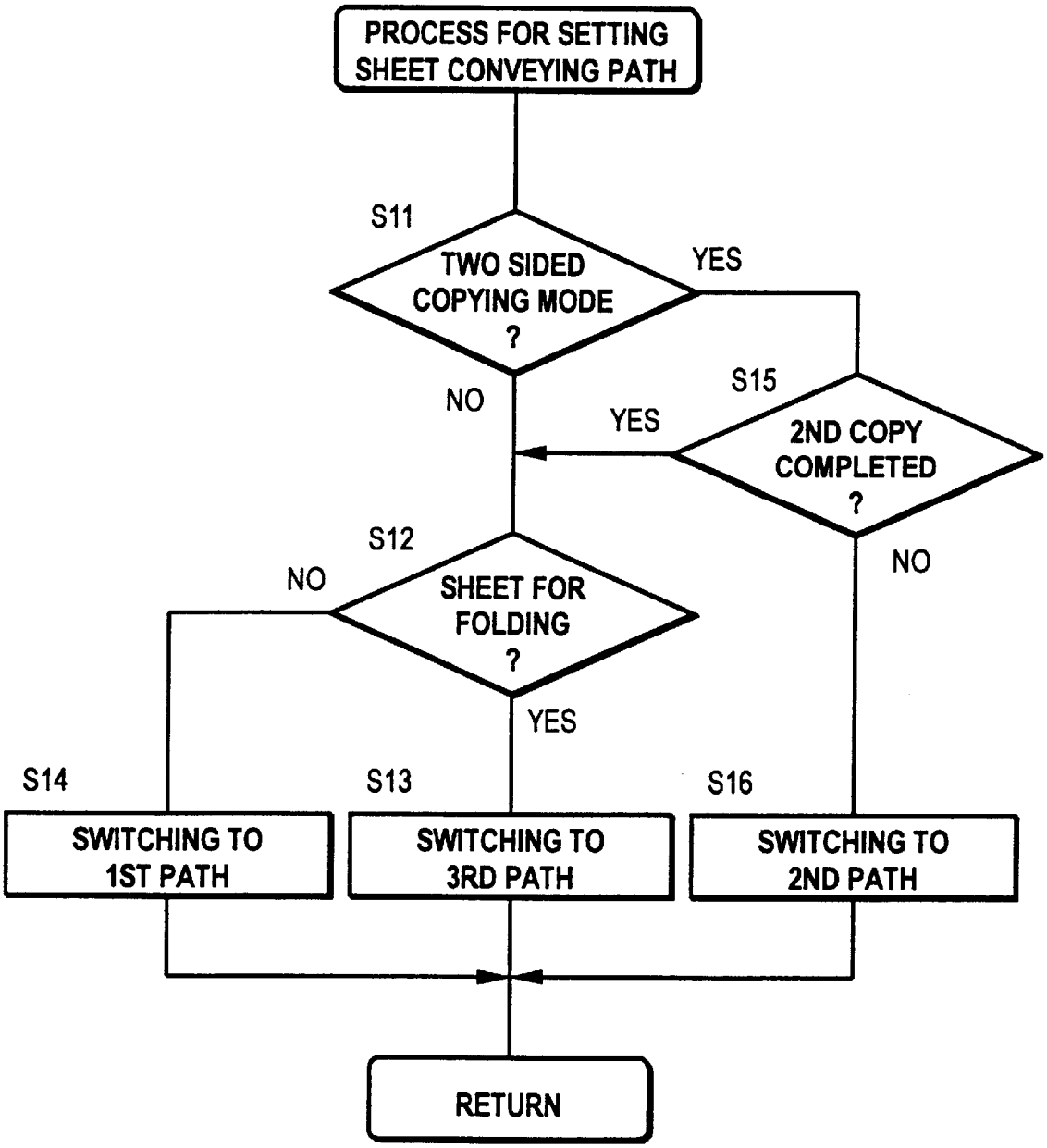
FIG. 11 is a flow chart of a process for setting a conveying path.

FIG. 11 is a flow chart illustrating the process for setting a sheet conveying path.

When the copy mode is not a two-sided copying mode ("N" at Step S11) and the judgment is "sheet for folding" ("Y" at Step S12), the copying machine 10 switches the conveying path to the third path 23 (Step S13). Then, the sheet is discharged from the sheet output section 10*b* without passing through the turn-back mechanism. In contrast, when the judgment is "sheet for no folding" ("N" at Step S12), the copying machine 10 switches the path to the first path 21. Then, the sheet is passed through the turn-back mechanism 20 and discharged in a reversed state from the sheet output section 10*b* (Step S14). The finisher 100, based on the information inputted from the copying machine 10, controls the rotation of the switch claw 201 disposed on the upstream side of the folding device 200 and the positions of the first and second folding stoppers 215, 216, 217, 223 and 219 in conformity to the relevant folding mode.

When the copy mode is a two-sided copying mode ("Y" at Step S11), the conveying path is temporarily switched to the second path 22 ("N" at Step S15, S16) after the first copy is completed on one side. After the second copy is completed on the other side ("Y" at Step S15), the operation described above is executed, depending on the result of the judgment whether or not the sheet folding is necessary.

The sheet folding in the folding device 200 is achieved by contacting the leading end of a sheet to the first and second folding stoppers 215, 216, 217223 and 219, and forming a loop halfway in the entire length of the sheet, and gripping the loop with the folding rollers 207, 208 and 209. The plurality of first folding stoppers 215, 216 and 217 as moving devices disposed along the conveying direction of the sheet are moved in and out by the cams 211, 212 and 213 connected to the stepping motor 210 as the drive source and can be retracted outside the sheet conveying path. The stepping motor 210, which actuates the cam shaft 224, is rotated by an angle proportionate to the number of received pulses. The forward and backward motions of the first folding stoppers 215, 216 and 217 are controlled in terms of the angle of rotation of the cam shaft 224 in response to the number of pulses inputted to the stepping motor 210 based on a home position at which the gobo 231 provided on the cam shaft 224 is detected by the home position sensor 230. The home position is defined as where all the first folding stoppers 215; 216 and 217 capable of forward and backward motions are retracted outside the conveying path.

In the folding device 200 of this embodiment, the ¾ fold as the first fold of Z-folding mode is done by setting the first folding stoppers at the positions separated from the paired folding rollers 207 208 by a distance equivalent to the length of ¾ of the sheet size. Accordingly, the first folding stopper 223 is only fixed at the position separated from the paired folding rollers 207, 208 by a distance equivalent to the length of ¾ of the largest sheet size (A3 in the longitudinal direction) in all the sheet sizes (A3 in the longitudinal direction and B4 in the longitudinal direction) that are capable of Z-folding.

Figure 12A:
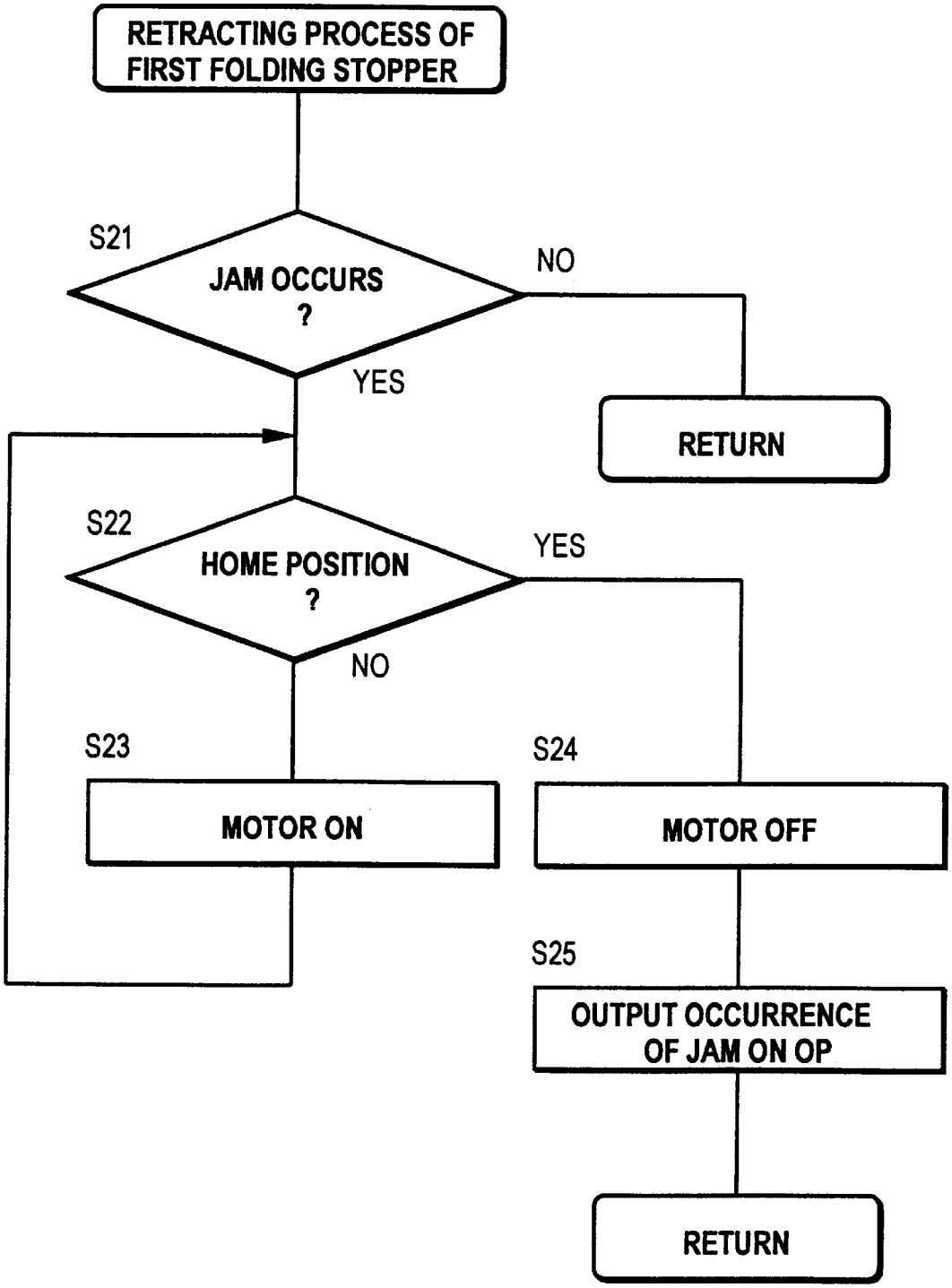
FIG. 12A is a flow chart of a process for retracting the first folding stopper during the restoration from a sheet jam.

FIG. 12A is a flow chart illustrating a procedure for retracting the first folding stopper during the restoration from a sheet jam.

When a jam of a sheet occurs in a folding device 200 ("Y" at S21), a decision as to whether or not the first folding stoppers 215, 216, 217 are at their home positions is made, based on a signal outputted from a home position sensor 230 (S22).

When the first folding stoppers are not at the home positions ("N" at S22), a stepping motor 210 remains in motion until they return to the home positions, namely until the home position sensor 230 detects a gobo 231 provided on a cam shaft 224 (S22, S23 and S24). After the first folding stoppers 215, 216, 217 have been returned to the home positions, the occurrence of the jam in the folding device 200 is outputted on a control panel OP of a copying machine (S25).

Figure 12B:
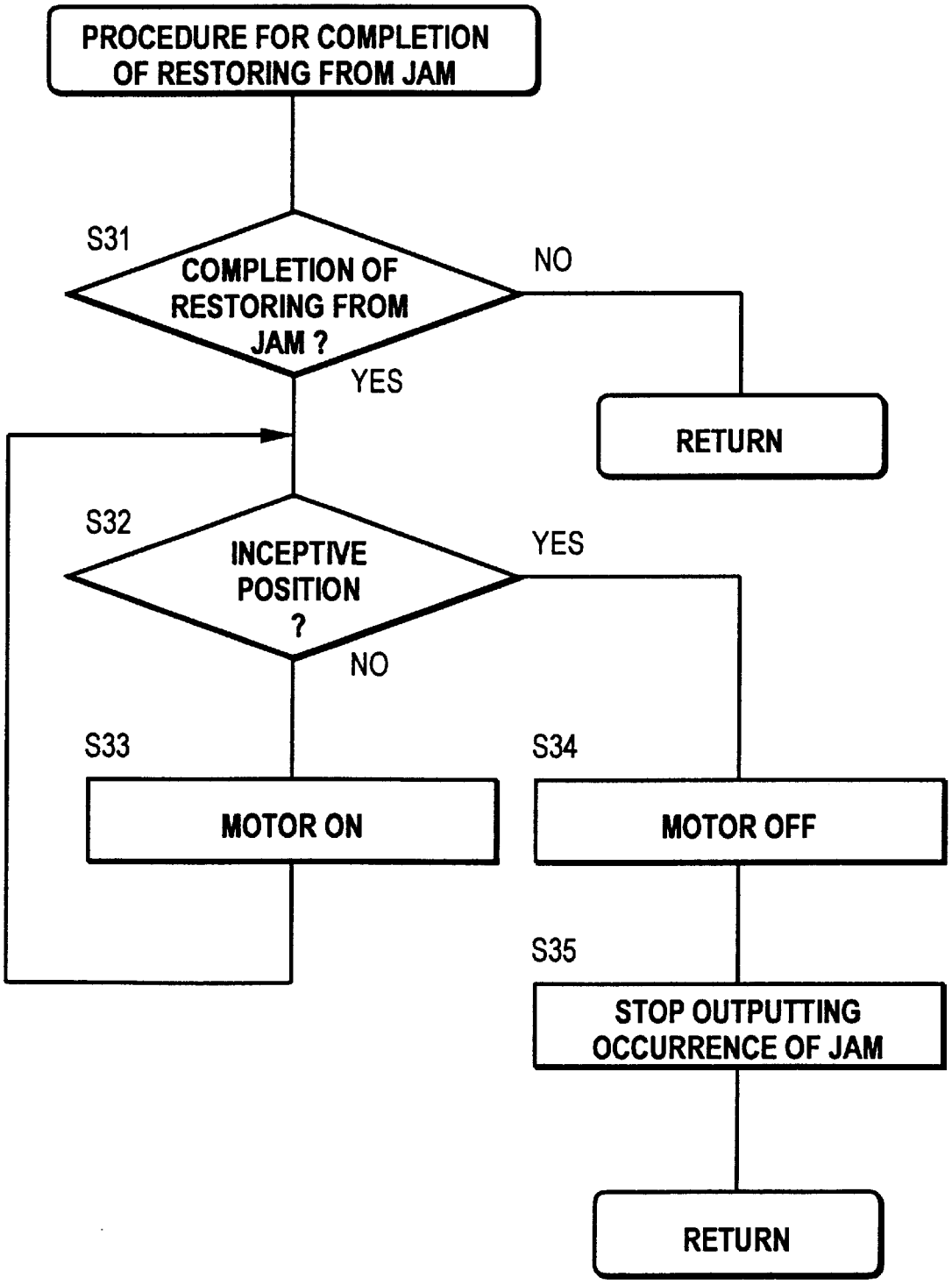
FIG. 12B is a flow chart of a procedure for the completion of a restoration from the jam.

FIG. 12B is a flow chart illustrating a procedure of the completion of restoration from the jam.

When the restoration from the jam is detected ("Y" at S31), the first folding stoppers 215, 216, 217 which have retreated to the home positions are moved forward or backward to the former or inceptive positions at the time of the occurrence of the jam (S32). After the first folding stoppers 215, 216, 217 have moved to the inceptive positions ("Y" at S32), the stepping motor 210 is stopped (S34) and outputting the occurrence of the jam on the control panel OP of the copying machine 10 is stopped (S35).

In brief, the first folding stopper is retracted outside the sheet conveying path and a space large enough for the user to insert his hand to the vicinity of the sheet in the jam is formed when the jam of sheet occurs. Consequently, the user can easily insert his hand and remove the jammed sheet. And there is no possibility that the user will accidentally touch and move the first folding stopper during the restoration from the jam and the first folding stopper keeps its accurate position. Further, no addition of any special mechanism is required and, since the user cannot accidentally touching the first folding stopper, the strength of the finisher can be at the level of an absolute minimum. Consequently, the finisher enjoys simplicity of construction and low cost.

Figure 13:
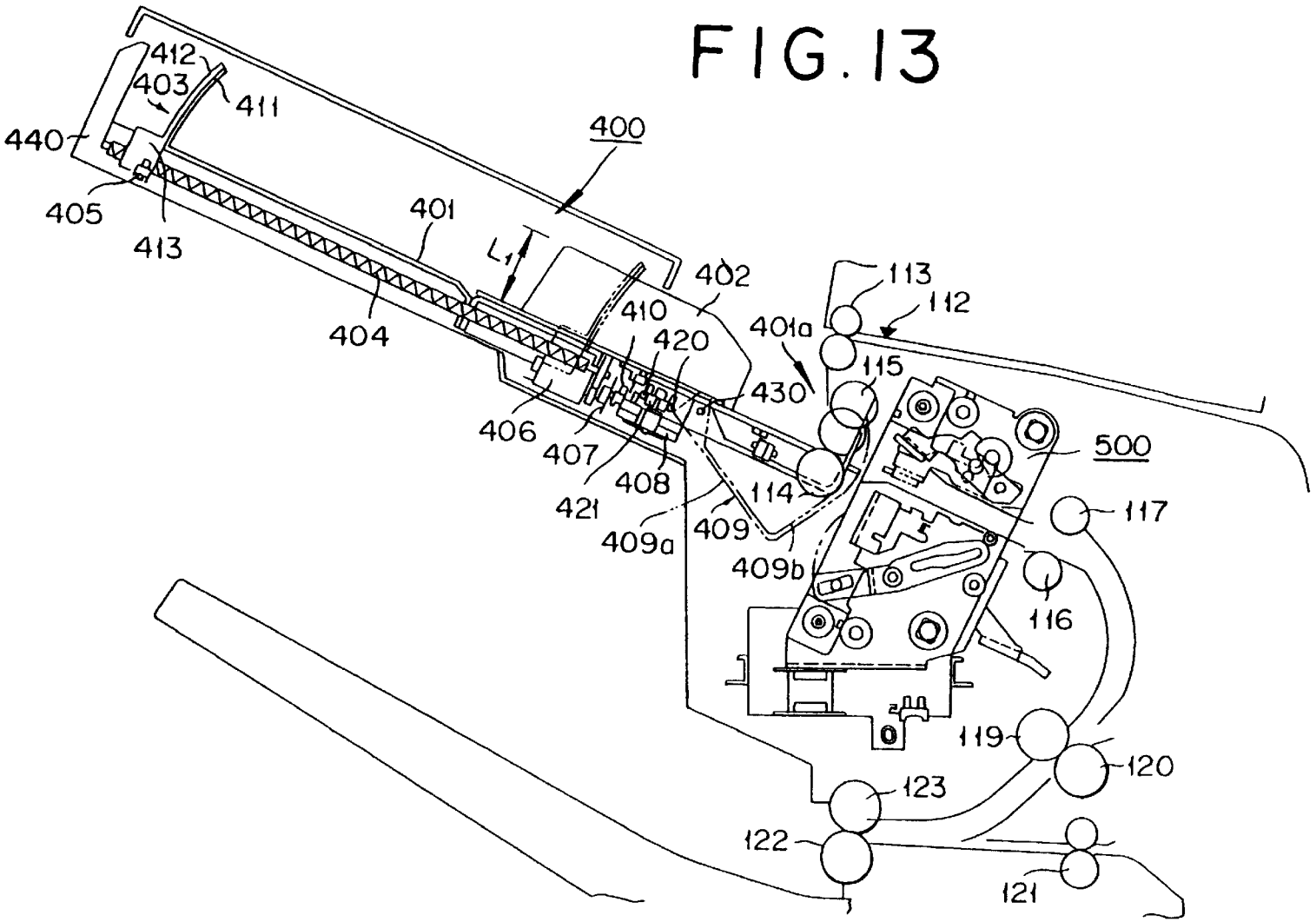
FIG. 13 is a cross sectional view of the construction of an additional-work tray unit and a stapler disposed in the downstream side.

FIG. 13 is a cross-sectional view illustrating the construction of the additional-work tray unit 400 and the stapler 500 disposed on the downstream side.

For the sake of convenience of the description, the alignment along the conveying direction from the additional-work tray 401 to the stapler 500 (FD-direction) will be referred to as "FD-alignment" and the alignment along the width direction of conveying sheet, i.e. the orhogonal direction (CD-direction), as "CD-alignment" hereinafter.

The additional-work tray unit 400 comprises the additional-work tray 401 which temporarily stores, in a face-down state, the sheet which is reversed upside down in the upstream section and then discharged by the discharging roller 113, a leading end stopper 409 which is disposed in the sheet discharging outlet 401*a* of the additional-work tray 401 and effects the FD-alignment of the sheet, a pair of lateral aligning plates 402 which effects the CD-alignment of the sheet discharged by the discharging roller 113, a trailing end stopper 403 which stabilizes the FD-alignment done with the leading end stopper 409 by contacting to the leading end of the sheet discharged by the discharging roller 113, and the first sheaf-conveying rollers 114, 115 which convey a certain number of sheets stored in the additional-work tray 401 as one sheaf to the stapler 500.

The additional-work tray 401 is set up such that the sheet-discharging outlet 401*a* is inclined downward by a certain angle. The pair of lateral aligning plates 402 is disposed such that they are freely moved symmetrically along the CD-direction. The pair of lateral aligning plates will be occasionally referred to hereinafter otherwise as "paired lateral aligning plates." The trailing end stopper 403 is disposed so as to move along the FD-direction freely. The CD-alignment is effected each time that the additional-work tray 401 receives a sheet. Besides, the FD-alignment is effected each time that the additional-work tray 401 receives a sheet or a certain number of sheets. The first sheaf-conveying rollers 114, 115 constitute a pair of the lower roller 114 and the upper roller 115. The upper roller 115 can move substantially in the vertical direction to press the lower roller 114 or depart from the lower roller 114.

The paired lateral aligning plates 402, are composed of plates having a height (L1) greater than the largest height of the sheaf that can be stored on the additional-work tray 401. The paired lateral aligning plates 402 are each mounted on a pair of racks 420 provided on the reverse side of the additional-work tray 401 along the CD-direction. The paired racks 420 are mounted opposed to each other across a gear 421 which is rotatably driven by a stepping motor 408. The rotation of the gear 421 causes the paired lateral aligning plates 402 to move symmetrically along the CD-direction. To be specific, the paired lateral aligning plates 402 synchronously move toward each other during the normal rotation of the stepping motor 408 and synchronously move away from each other during the reverse rotation of the stepping motor 408.

The paired lateral aligning plates 402 have two waiting positions, i.e. a first waiting position and a second waiting position. The first waiting position is a place occupied before the discharging roller 113 discharges the sheet. The second waiting position, as altered by the size of the sheet to be discharged, occupies a slightly wider area than the size of the sheet and is a place for awaiting the discharge of the sheet by the discharging roller 113. The paired lateral aligning plates 402 are freely moved between the three positions, i.e. the first waiting position, the second waiting position, and the position for the CD-alignment of the sheet discharged by the discharging roller 113.

A plurality of sensors for positioning the paired lateral aligning plates 402 are provided on the lower face of the additional-work tray 401. The gobos, or stops for intercepting the light from the sensors 410 are integrally mounted on the paired lateral aligning plates 402. Positioning of the first and second waiting positions-are based on that the gobos intercept the light from the sensors 410. The positioning of the paired lateral aligning plates 402 for the alignment is done by controlling the number of pulses inputted the stepping motor 408 to actuate the gear 421.

The leading end stopper 409 is roughly shaped like a letter L and is composed of a bottom plate 409*a* and a blocking plate 409*b* raised from the leading end of the bottom plate 409*a*. The leading end stopper 409 is so mounted on the lower face of the additional-work tray 401 to freely rotate about a fulcrum 430 provided on the bottom plate 409*a*. The leading end stopper 409 is urged by the elastic force of a spring to come in contact with the lower face of the additional-work tray 401. The blocking plate 409*b* of the leading end stopper 409 forms a base plane when the FD-alignment is effected on the sheet to be stored in the additional-work tray 401. The blocking plate 409*b* of the leading end stopper 409 is moved downward as indicated by a phantom line in FIG. 13, by actuating a solenoid to pull a link arm (not shown) pivotally supported on a rotary fulcrum 430. It results in opening the sheet-discharging outlet 401*a* for feeding a sheaf to the stapler 500.

The trailing end stopper 403 comprises a plate 412, a sponge 411 attached to one face of the plate 412 to which the sheet contacts, and a framer 413 supporting the plate 412. Roughly the upper half of the plate 412 is rounded, or radius-shaped by being projected as slightly curved from the direction perpendicular to the upper face of the additional-work tray 401 toward the leading stopper 409 located on the sheet discharging outlet 401*a*.

The plate 412 of the trailing end stopper 403 with the rounded shape produces the following advantages. The trailing end of the sheet along the conveying direction from the additional-work tray 401 to the stapler 500 (corresponding to the leading end of the sheet being discharged from the discharging roller 113) always steadily contacts the plate 412 of the trailing end stopper 403 without reference to the number of sheets stacked on the additional-work tray 401, the size of the sheet, or the presence or absence of folding. In consequence of this contact, the sheet is repelled in the direction opposite the discharging direction and the leading end of the sheet along the conveying direction infallibly comes in contact with the leading end stopper 409 and the FD-alignment is further ensured. The Z-folding sheet, owing to the crease, has the trailing end along the conveying direction in a slightly lifted state. However, the sheaf including Z-folding sheets can be uniformly pushed in and brought into contact with the leading end stopper 409 by using the plate 412 having the radius-shaped upper part. Thus, the additional-work tray unit 400 can infallibly eliminate the deviation in the conveying direction possibly produced in the sheaf including Z-folding sheets during the conveyance to the stapler 500.

The framer 413 of the trailing end stopper 403 is engaged with a spiral shaft 404 which is installed as extended along the conveying direction at the center of the lower face of the additional-work tray 401. This spiral shaft 404 is connected to a motor 406, such as a DC motor, through a transmission device (not shown), such as a gear train. The trailing end stopper 403 is moved forward or backward by a necessary distance along the conveying direction by actuating the motor 406 properly in the normal or reverse direction to rotate the spiral shaft 404.

Figure 14A:
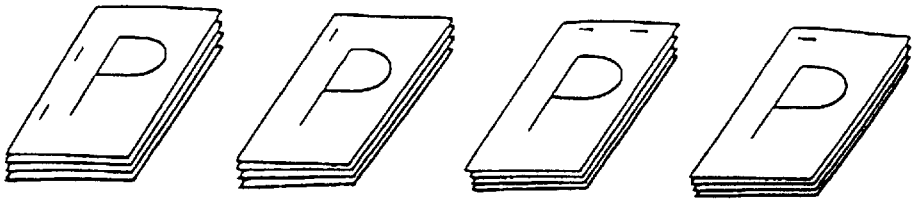
FIG. 14A is a diagram illustrating the normal staple mode.
Figure 14B:
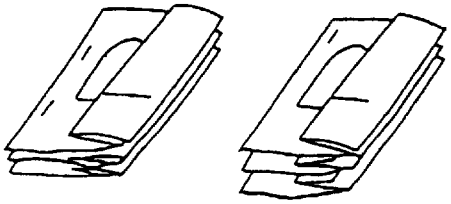
FIG. 14B is a diagram illustrating the fold staple mode functions.
Figure 14B:
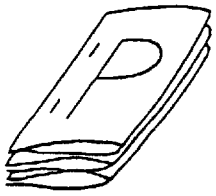
Figure 14B:
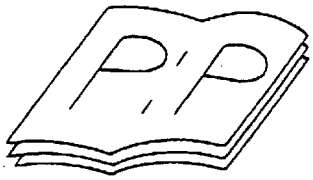
Figure 14C:
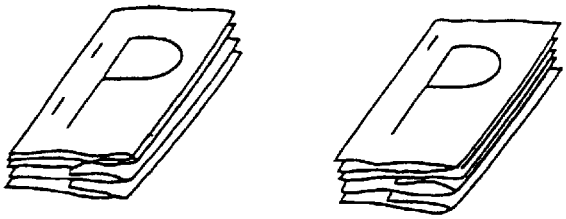
FIG. 14C is a diagram illustrating the mixed staple mode functions.

FIGS. 14A–14C are diagrams illustrating the states of various staple modes. The stapler has three staple modes, i.e. normal staple mode (FIG. 14A), fold staple mode (FIG. 14B), and mixed staple mode (FIG. 14C), which are selectively adopted. The normal staple mode is a mode for stapling a sheaf solely of unfolded sheets, the fold staple mode is a mode for stapling a sheaf solely of folded sheets, and the mixed staple mode is a mode for stapling a sheaf of unfolded and folded sheets.

Without reference to the kind of staple mode, the folded and/or unfolded sheets are stacked on the additional-work tray 401 prior to the relevant stapling, subjected to the CD-alignment by the paired lateral aligning plates 402, and then subjected to the FD-alignment performed jointly by the trailing end stopper 403 and the leading end stopper 409.

After the CD-alignment and the FD-alignment are completed in the additional-work tray 401, the sheaf is nipped by the first sheaf-conveying rollers 114, 115 and passed through the sheet discharging outlet 401*a* opened in consequence of the rotation of the leading end stopper 409 and then conveyed toward the stapler 500.

The paired lateral aligning plates 402 are located based on the pulses inputted to the stepping motor 408 and the signal outputted from the sensor 410 which detects the paired lateral aligning plates 402 at the home position. The paired lateral aligning plates 402, after discerning the size of a sheet for copying, move to a position separated slightly from the lateral end of the sheet and assume a waiting posture and effect the CD-alignment by making reciprocating motion each time one sheet is received for storage. The home position is separated by a minute length from the lateral end of a sheet stored in the additional-work tray 401, which has the largest length in the CD-direction.

The trailing end stopper 403 is located in accordance with the pulses outputted from the pulse disc sensor 407 provided as a pulse generating device in the motor 406 and the signal outputted from the sensor 405 detecting the trailing end stopper 403 at the home position. The trailing end stopper 403, after discerning the size of sheet for copying and the mode of sheet folding, produces a motion proper for the size of a sheet received into the additional-work tray 401. The home position is separated by a minute length from the trailing end of a sheet stored in the additional-work tray 401, which has the largest length in the FD-direction.

When a jam occurs inside the additional-work tray unit 400, first the paired lateral aligning plates 402 and the trailing end stopper 403 are returned to their respective home positions and then the fact that the jam has occurred in the additional-work tray unit 400 is outputted on the control panel on the copying machine 10.

After the completion of the restoration from the jam is detected, the paired lateral aligning plates 402 and the trailing end stopper 403 are both moved to the positions which they occupied when the jam occurred.

Figure 15:
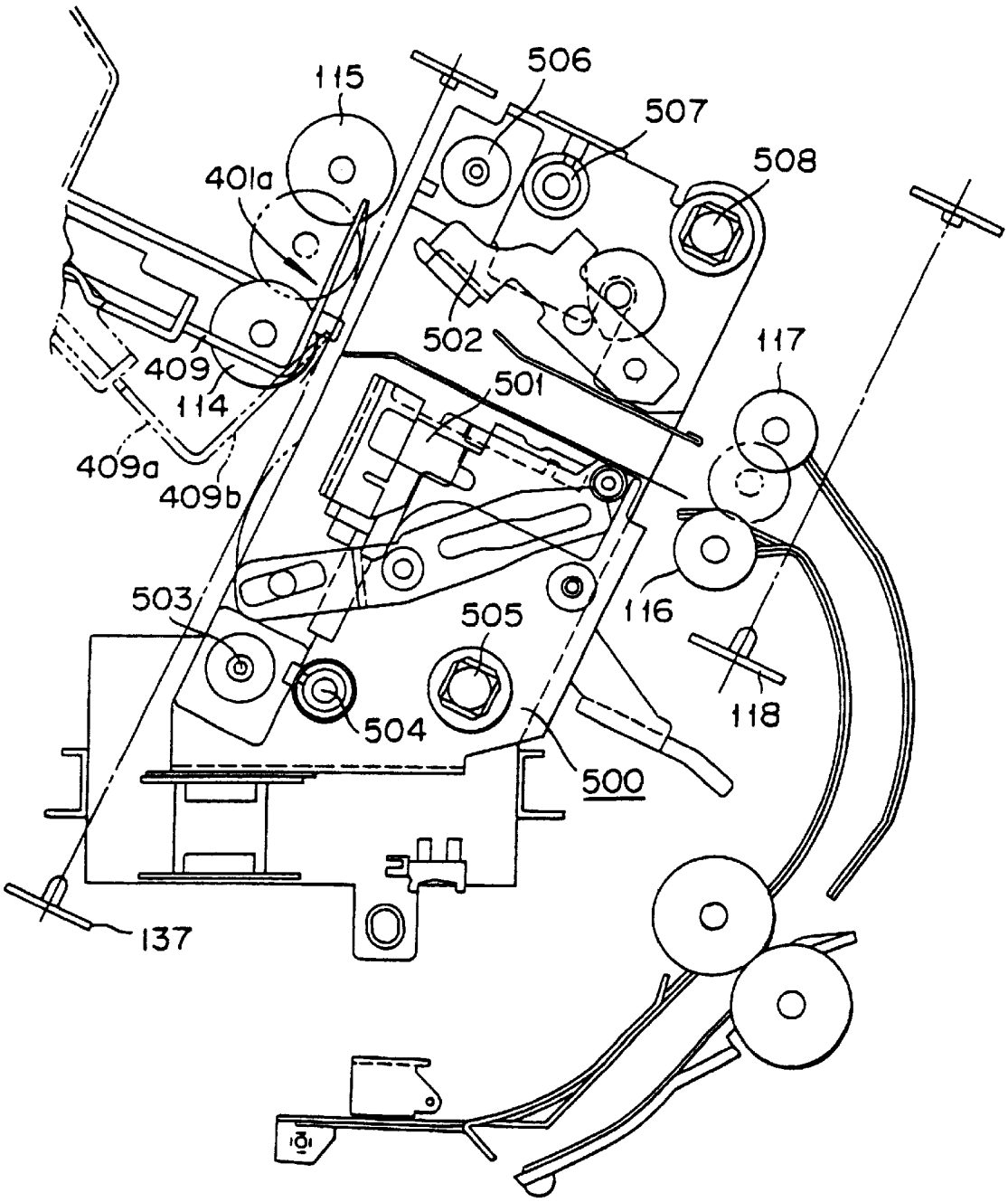
FIG. 15 is a cross-sectional view of a stapler together with a first and a second sheaf-conveying rollers.
Figure 16:
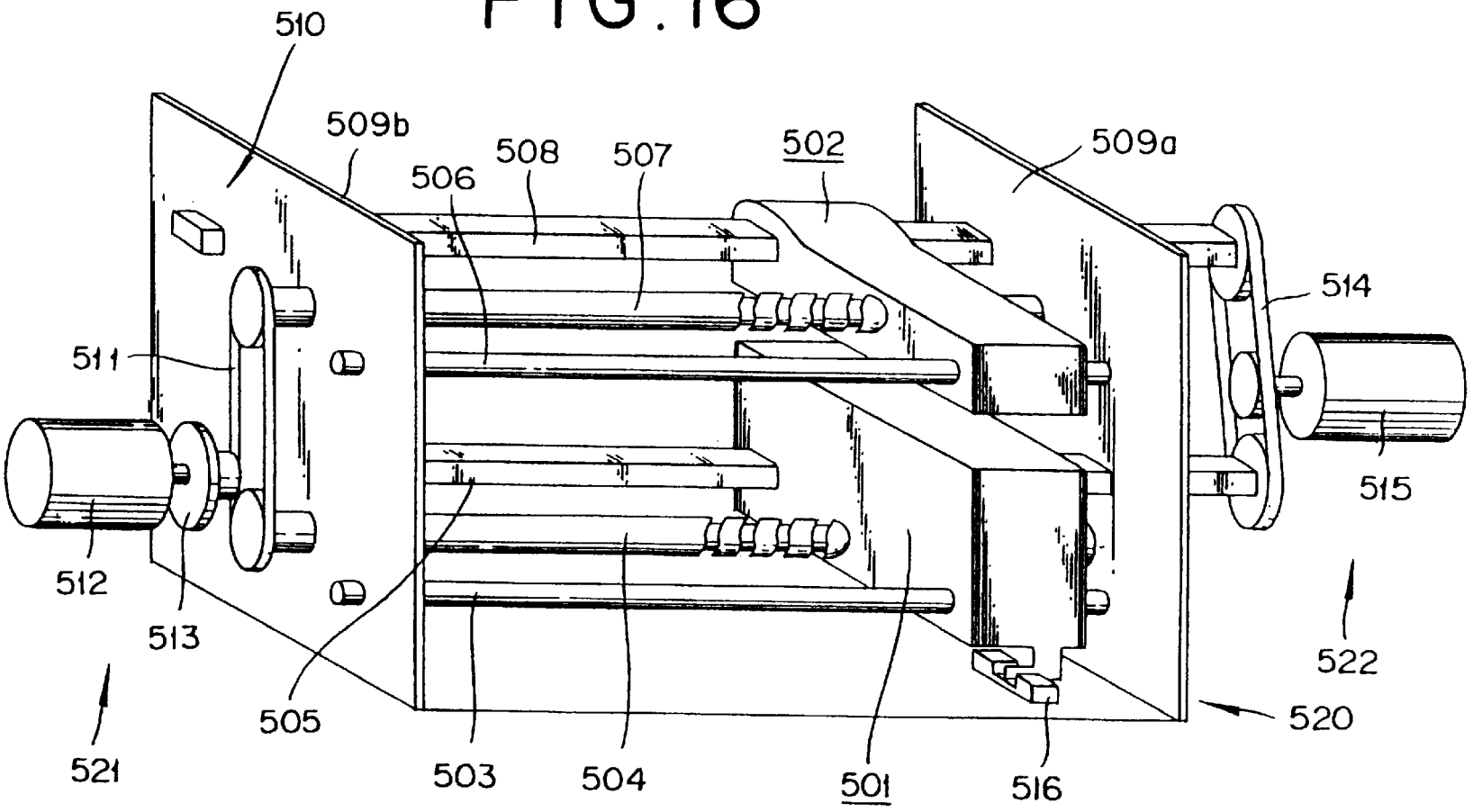
FIG. 16 is a perspective view of the construction of the stapler.

FIG. 15 is a cross-sectional illustrating the stapler 500 together with the first and second sheaf-conveying rollers 114–117 and FIG. 16 is a perspective view illustrating the construction of the stapler 500.

The stapler 500 performs a stapling at certain positions of a sheaf nipped and conveyed by the first sheaf-conveying rollers 114, 115 on the upstream side of the stapler 500 relative to the conveying direction. The stapler 500 comprises a head unit 501, an anvil unit 502, a supporting mechanism 520 which supports the units 501, 502 such that the units 501, 502 are freely moved in the orthogonal direction and rotated, a first drive mechanism 521 which moves the units 501, 502, and a second drive mechanism 522 which rotates the units 501, 502. In the stapler 500, devices which engage or connect the head unit 501 with the anvil unit 502 do not transverse the sheet conveying path.

Further, the second sheet-conveying rollers 116, 117 which convey the stapled sheaf and the second sensor 118 for fixing the stapling position of the sheaf (as will be specifically described herein below) are installed on the downstream side of the stapler 500.

The head unit 501 separates one staple from a cartridge held within a cartridge case (not shown), bends the separated staple in the shape nearly resembling a letter U, and transfixes the sheaf with the bent staple. This unit 501 is provided with a sensor which detects the presence or absence of staple in the cartridge case.

The anvil unit 502 inwardly bends shanks of the staple which has penetrated through the sheaf and receives the shock of stapling performed by the head unit 501. This unit 502 comprises a receiving plate, which inwardly bends the shanks of the staple, and a supporting plate, which receives the shock of the stapling action.

The supporting mechanism 520, as illustrated schematically in FIG. 16, comprises a frame 510 provided with a pair of lateral wall 509*a,* 509*b* and supporting shafts 503, 506 extending along the orthogonal direction and supported by the frame 510. The distance between the lateral wall 509*a,* 509*b* of the frame 510 is set to surpass at least the length of a sheet in the orthogonal direction, which is passable. The supporting shafts 503, 506 are each formed of a round bar. The supporting shaft 503 is inserted through the head unit 501 and the supporting shaft 506 is inserted through the anvil unit 502. The units 501, 502 are freely moved in the orthogonal direction along the supporting shafts 503 and 506 and are freely rotated respectively about the supporting shafts 503 and 506, respectively.

The first drive mechanism 521 comprises a spiral shaft 504 inserted through the head unit 501 and a spiral shaft 507 inserted through the anvil unit 502. The spiral shafts 504, 507 extend along the orthogonal direction and supported by the frame 510. In consequence of the rotation of the spiral shaft 504, the head unit 501 is moved in the orthogonal direction as guided by the supporting shaft 503. In consequence of the rotation of the spiral shaft 507, the anvil unit 502 is moved in the orthogonal direction as guided by the supporting shaft 506.

The second drive mechanism 522 comprises a drive shaft 505 inserted through the head unit 501 and a drive shaft 508 inserted through the anvil unit 502. The drive shafts 505, 508 extend along the orthogonal direction and supported by the frame 510. In consequence of the rotation of the drive shaft 505, the driving force for transfixing a sheaf is transmitted to the head unit 501 and the head unit 501 is rotated about the supporting shaft 503 as a center. In consequence of the rotation of the drive shaft 508, the driving force for bending shanks of a staple is transmitted to the anvil unit 502 and the anvil unit 502 is rotated about the supporting shaft 506 as a center. The drive shafts 505, 508 include a shaft possessed of a rectangular cross section incapable of generating slippage for the purpose of infallibly transmitting the driving force to the units 501,502. When the drive shafts are formed of a round bar, the slippage between the drive shafts and the units 501 and 502 may be precluded by means of a key or a key groove, for example.

The units 501, 502 can be linearly moved independently and parallel along the orthogonal direction with the aid of the plurality of shafts 503–505 and 506–508, which are inserted respectively.

The head unit 501 and the anvil unit 502 are moved along the orthogonal direction by the rotation of the spiral shafts 504, 507 which have the same phases. A timing belt 511 is suspended as passed around the spiral shafts 504, 507. This belt 511 is connected to a drive motor 512. The drive motor 512 is formed of a DC motor and enabled by a pulse disc sensor 513 to produce a controlled rotation. Owing to the construction, the units 501, 502 can be each moved in an equal distance. The first drive mechanism 521 is composed of the spiral shafts 504 and 507, the timing belt 511, the drive motor 521, etc.

A light-permeable sensor 516 is mounted on the frame 510 for detecting the home positions of the units 501, 502. After detecting the gobos provided on the head unit 501 by the sensor 516, the units 501, 502 are both moved to the respective home positions. The distances of movement of the units 501, 502 are set on the basis of the home positions.

The head unit 501 and the anvil unit 502 are actuated to produce the transfixing motion by the rotation of the drive shafts 505, 508. A belt 514 is suspended as passed around the drive shafts 505, 508. This belt 514 is connected to a drive motor 515. Owing to this construction, the units 501, 502 are each driven to transfix a sheaf at positions arbitrarily selected in the orthogonal direction. The second drive mechanism 522 is composed of the drive shafts 505 and 508, the belt 514, the drive motor 515, etc.

The head unit 501 and the anvil unit 502 of the stapler 500 at first stand at rest at the home positions for intercepting the light from the sensor 516. The sheets outputted from the copying machine 10 are conveyed to the additional-work tray 401 and are stacked and aligned. When as many sheets as suffice for one job are stacked on the additional-work tray 401, the stacked sheet are conveyed as a sheaf in the direction of the stapler 500.

The first sheaf-conveying rollers 114, 115 as a conveying device for nipping and conveying the sheaf to the stapler 500 can control the conveying distance of the sheaf by the amounts of their rotation. The first sheaf-conveying rollers 114, 115 convey the sheaf at a position such that the stapling position arbitrarily selected on the sheaf coincides with the transfixing position.

Thereafter, the drive motor 512 is actuated to rotate the spiral shafts 504, 507 through the belt 511 while the pulse disc sensor 513 detects the amount of rotation. The units 501, 502 are each moved over an equal distance in the direction of the stapling positions selected arbitrarily. When the units 501, 502 are stopped at the selected stapling positions, the drive motor 515 is actuated to rotate the drive shafts 505, 508 through the belt 514. The units 501, 502 are rotated to transfix a sheaf.

When the stapling is performed at a plurality of points falling on a straight line along the orthogonal direction, the units 501, 502 are moved to the next transfixing point by the operation of the motor 512 after completing the transfixing work at the first point. Then, the motor 515 is actuated to perform the transfixing work. By repeating this process, the stapling work at the plurality of points is wholly completed.

As shown in FIG. 15, first sheaf-conveying rollers 114, 115 which are composed of a pair of rollers (upper and lower rollers) are disposed in the upstream section and second sheaf-conveying rollers 116, 117 which are composed of a pair of rollers (upper and lower rollers) are disposed in the downstream section of a stapler 500. The distance between the nip position of the first sheaf-conveying rollers 114, 115 and the nip position of the second sheaf-conveying rollers 116, 117 is set at a size slightly smaller than the smallest of the sizes of sheets to be conveyed.

A first DC motor drives the first sheaf-conveying rollers 114, 115 to be moved toward each other until pressure contact or separated away from each other. A stepping motor rotates the rollers 14, 15. The conveying distance of the sheaf is adjusted by controlling the revolving speed of the stepping motor. The second sheaf-conveying rollers 116, 117 are constructed similarly to the first sheaf-conveying rollers 114, 115. A second DC motor drives the second sheaf-conveying rollers 116, 117 to be moved toward each other until pressure contact or separated away from each other, independently of the first sheaf-conveying rollers 114, 115. The stepping motor, which drives the first sheaf-conveying rollers 114 and 115, also rotates the second sheaf-conveying rollers 116, 117 and controls the conveying distance of the sheaf. The rollers 114–117 are invariably formed of an identical material with low hardness and in a geometrical similar shape. The rollers 116, 117 have a smaller diameter than the rollers 114, 115.

A first sensor 137 which detects the edge of a sheaf being fed is disposed near the downstream side of the first sheaf-conveying rollers 114 and 115, and a second sensor 118 is disposed near the downstream side of the second sheaf-conveying rollers 116, 117 as illustrated in FIG. 15. The sensors 118, 137 are set at a position separated by a certain distance from the stapling position.

The conveying path at least between the first sheaf-conveying rollers 114, 115 and the second sensor 118 is formed of a straight conveying guide.

The leading end of the sheaf has been aligned by a leading end stopper 409 during the temporary storage of sheets. In this state, the first sheaf-conveying rollers 114, 115 begin movement toward each other until pressure contact. Thus, the first sheaf-conveying rollers 114, 115 nip the leading end of the sheaf in the aligned state.

The conveying path between the first sheaf-conveying rollers 114, 115 and the stapling position has a straight shape. The leading end of the sheaf retains the aligned state intact even when the sheaf is nipped and conveyed by the first sheaf-conveying rollers 114, 115 to the stapling position.

If the conveying path in the downstream side in the conveying direction-from the first sheaf-conveying rollers 114, 115 is bent like an arc, a sheaf of sheets will become long along a guide plate having an arc of a small radius and short along a guide plate having an arc of a large radius such that the leading end of the sheaf is slanted relative to the guide plate. If the stapler staples the sheaf in the direction perpendicular to the guide plates, it will inevitably bind the sheaf obliquely in conclusion, the conveying path between the first sheaf-conveying rollers 114, 115 and the stapling position must be in a straight shape when the stapler 500 staples a sheaf being nipped by the first sheaf-conveying rollers 114, 115.

The present embodiment, as will be described herein below, is constructed such that the first sheaf-conveying rollers 114, 115 nip and convey a sheaf, and the second sheaf-conveying rollers 116, 117 nip and convey the sheaf additionally, and the first sheaf-conveying rollers 114, 115 release the sheaf, and the second sheaf-conveying rollers 116, 117 nip and convey the sheaf exclusively, and the stapler 500 staples the sheaf. The finisher must keep the aligned leading end of the sheaf, which is nipped and conveyed by the first sheaf-conveying rollers 114, 115 solely, intact until the second sheaf-conveying rollers 116 nip and convey the sheaf additionally. Thus, the conveying path between the first sheaf-conveying rollers 114, 115 and the second sensor 118 which is located at the position of the sheaf at which the second sheaf-conveying rollers 116, 117 begin to nip the sheaf, must be in a straight shape.

The finisher includes the second sheaf-conveying rollers 116, 117 which nip the sheaf on the downstream side from the stapling position. Therefore, the conveying path extending in the downstream side of the second sensor 118 does not need to be in a straight shape but may be bent like an arc, for example. The bending of the conveying path can prevent the whole finisher from growing in size.

Figure 17:
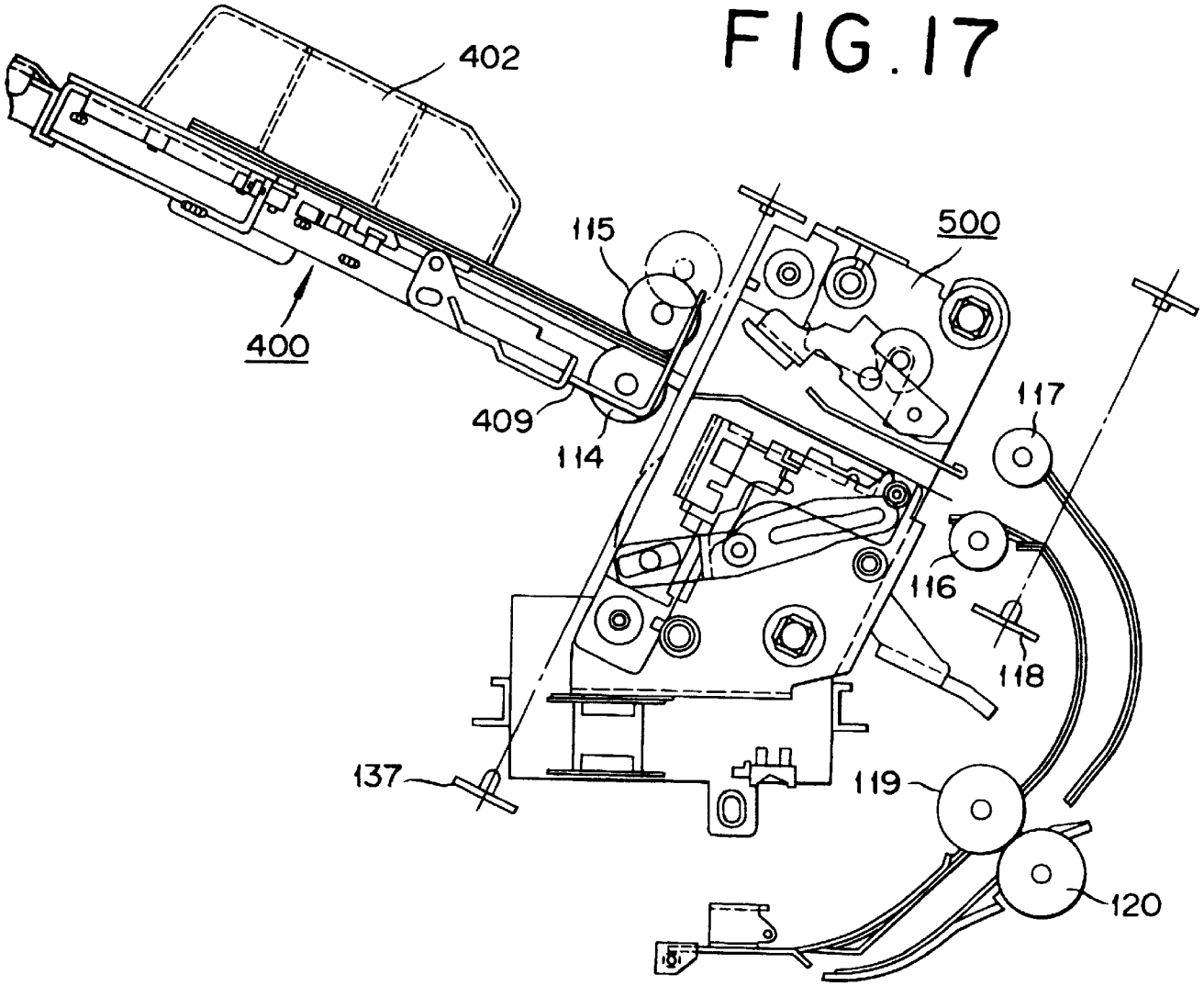
FIG. 17 is a cross-sectional view of the operation of positioning for the staple mode.

When the staple mode is selected, sheets are stacked on the additional-work tray 401. At this time, the first sheaf-conveying rollers 114, 115 are separated from each other. After the temporary stacking or storing of the sheets is completed, the first sheaf-conveying rollers 114, 115 are shifted to a mutually pressed state to nip a sheaf of the sheets and the leading end stopper 409 retracts outside the conveying path. Then, the sheaf is conveyed by rotating the first sheaf-conveying rollers 114, 115 and the stapling position is located along the conveying direction. The present embodiment contemplates three staple modes. The first mode is "leading end bind" which binds the leading end of the sheaf along the conveying direction. The second mode is "center bind" which binds the central section of the sheaf along the conveying direction. The third mode is "trailing end bind" which binds the trailing end of the sheaf along the conveying direction. The operation of the positioning depends on these modes. The each operation of the location for modes will be described below with reference to FIG. 17.

The leading end of the sheaf has already undergone the FD-alignment during the temporary stacking of sheets with the blocking plate 409*b* of the leading end stopper 409 used as a regulating face. In the mode of leading end bind, it suffices for the location of the stapling position to convey the sheaf in a certain distance without reference to the size of sheet even when the sheaf have been given a Z-folding, for example. To be specific, it is only required that the first sheaf-conveying rollers 114, 115 convey the sheaf in the distance resulting from adding the length from the leading end of the sheaf to the desired stapling position (normally about 10 mm) to the length from the blocking plate 409*b* of the leading end stopper 409 to the stapler 500.

Thereafter, the rollers 114, 115 are stopped and the stapler 500 is actuated to staple the sheaf. The conveyance of the sheaf is resumed after the completion of the stapling. The conveyance of the sheets is stopped when the leading end completely reaches the second sheet-conveying rollers 116, 117. The second sheet-conveying rollers 116, 117 are shifted to a mutually pressed state to nip the leading end of the sheaf. Then, the second sheet-conveying rollers 116, 117 are rotated to start the conveyance of the sheaf again.

The first DC motor is actuated with continuing the conveyance of the sheaf and exclusively shifts the first sheaf-conveying rollers 114, 115 to a mutually separated state. The sheaf is subsequently conveyed and nipped by the second sheet-conveying rollers 116, 117 toward the accumulating tray unit 600.

The stepping motor rotates the first and second sheaf-conveying rollers 114–117. The conveying distance of the sheaf is controlled by regulating the pulses of the stepping motor.

In the mode of center bind, the stapling is done in the central section of the sheaf along the conveying direction. Naturally, the conveying distance of the sheaf for the stapling varies with the size of sheet. The conveying distance is long as compared with that involved in the mode of leading end bind.

The stepping motor conveys the sheaf. It is theoretically possible to control, by simply changing pulses, the conveying distance even when the conveying distance is long. However, the diameters of the sheaf-conveying rollers 114–117 and the widths of the nips cannot be thoroughly freed from dimensional dispersions. Namely, the inaccuracy in the actual conveying distance enlarges in proportion as the conveying distance lengthens. To reduce the inaccuracy, the conveyance of the sheaf in the mode of center bind is effected as follows.

First, a sheaf is nipped and conveyed by the first sheaf-conveying rollers 114, 115. After the second sensor 118 disposed in the downstream side of the second sheet-conveying roller 116, 117 has detected the leading end of the sheaf, the sheaf is further conveyed in a distance proper for the sheet size and is stopped. Then, the sheaf is stapled.

At this time, the leading end of the sheaf has completely reached the second sheet-conveying rollers 116, 117. The second sheet-conveying rollers 116, 117 nip the sheaf. Then, the second sheet-conveying rollers 116, 117 are rotated to resume the conveyance of the sheaf. Meanwhile the first DC motor is actuated to shift the first sheaf-conveying rollers 114, 115 alone to a mutually separated state, continuing the conveyance of the sheaf. Thereafter, the sheaf is conveyed and nipped by the second sheet-conveying rollers 116, 117 toward the accumulating tray unit 600.

Incidentally, in the mode of center bind, sheets having a length not less than twice the length of a sheet of the smallest size to be conveyed are only applicable.

The following steps are adopted in the leading end bind and center bind modes in order to shorten the total time required for the conveyance of the sheaf and improve the productivity. Namely, the first sheaf-conveying rollers 114, 115 positioned in the upstream side and the second sheaf-conveying rollers 116, 117 positioned in the upstream side of the stapler 500 nip and convey the sheaf together, and then the first sheaf-conveying rollers 114, 115 are switched to a state of mutual separation while the conveyance is in process.

In the mode of trailing end bind, first the sheaf is nipped and conveyed by the first sheaf-conveying rollers 114, 115. When the leading end of the sheaf completely reaches the second sheet-conveying rollers 116, 117, the conveyance is stopped and the sheaf is nipped by the second sheet-conveying rollers 116, 117.

After the completion of the nipping by the second sheet-conveying rollers 116, 117, the first DC motor is actuated to shift the first sheaf-conveying rollers 114, 115 to a mutually separated state. At this time, the conveyance of the sheaf is not proceeding.

The reason for the suspended conveyance is that the sheaf has not yet been stapled by the time that it is nipped by the second sheaf-conveying rollers 116, 117 unlike in the leading end bind mode or the center bind mode, and the individual sheets of the sheaf are inevitably deviated when the conveyance of the sheaf begins again without waiting the completion of separating the first sheaf-conveying rollers 114, 115 mutually and a deviation or difference happens to occur in the timing for starting or in the speed of conveyance between the first sheaf-conveying rollers 114, 115 and the second sheaf-conveying rollers 116, 117. In short, the suspended conveyance can preclude the deviation in the sheaf.

After the completion of the operation for mutually separating the first sheaf-conveying rollers 114, 115, the second sheet-conveying rollers 116, 117 are rotated to resume the conveyance of the sheaf. When the second sensor 118 detects the leading end of the sheaf, the sheaf is stopped after conveyed in a certain distance proper for the sheet size. Then the sheaf is stapled.

The stapled sheaf resumes being conveyed and nipped by the second sheet-conveying rollers 116, 117 toward the accumulating tray unit 600.

In the above mode of conveyance, the conveying distance is set based on the position of the second sensor 118. Optionally, the conveying distance in the mode of trailing end bind may be set based on the position of the first sensor 137 which is disposed in the downstream side of the first sheaf-conveying rollers 114, 115. In the present mode, the sheaf is conveyed in a certain distance after the first sensor 137 has detected the trailing end of the sheaf. Namely, the sheaf has only to be conveyed in a prescribed distance without reference to the size of sheet. The first sensor 137 approximates closely the stapling position. Advantageously, it results in shortening the conveying distance and improving the positioning accuracy.

The head unit 501 and the anvil unit 502 of the stapler 500 are so constructed as to be moved in the orthogonal direction by the drive motor 512 as a DC motor. The drive motor 512 is provided with the pulse disc sensor 513 as a pulse generating device and controls the positions of the units 501, 502 based on the pulses outputted from the pulse disc sensor 513 and the signal outputted from the sensor 516 which detects the units 501, 502 at the home positions. The home positions of the units 501, 502 are the positions approximated most closely to the front face of the finisher 100 inside the frame 510, i.e. the positions at which the units 501, 502 are kept waiting outside the conveying path.

When a jam of sheet occurs in the stapling is being performed on the sheaf which have been stacked in the additional-work tray 401 and conveyed to the stapler 500, the units 501, 502 respectively are returned to the home positions and then the fact that the jam of sheet has occurred in the stapler is outputted on the control panel of the copying machine 10.

When the completion of restoration from the jam is detected, the units 501, 502, which have retracted to the home positions, are moved to the positions which they assumed when the jam of sheet occurred.

The sheet discharge unit which discharges sheets to the accumulating tray unit 600 as illustrated in FIG. 2, comprises the third sheet-conveying rollers 119, 120 which conveys the sheaf, the conveying roller 121 disposed in the downstream side of the switch claw 103 and conveys a lone sheet, and discharging rollers 122, 123 which outputs the sheaf or the single sheet into the accumulating tray 601 in addition to the first and second sheaf-conveying rollers 114, 115 and 116, 117.

Namely, the accumulating tray unit 600 is so constructed as to receive a sheaf of sheets, which is discharged from the additional-work tray 401 and stapled by the stapler 500, and an unstapled single sheet, which is conveyed through the other conveying path.

Figure 18:
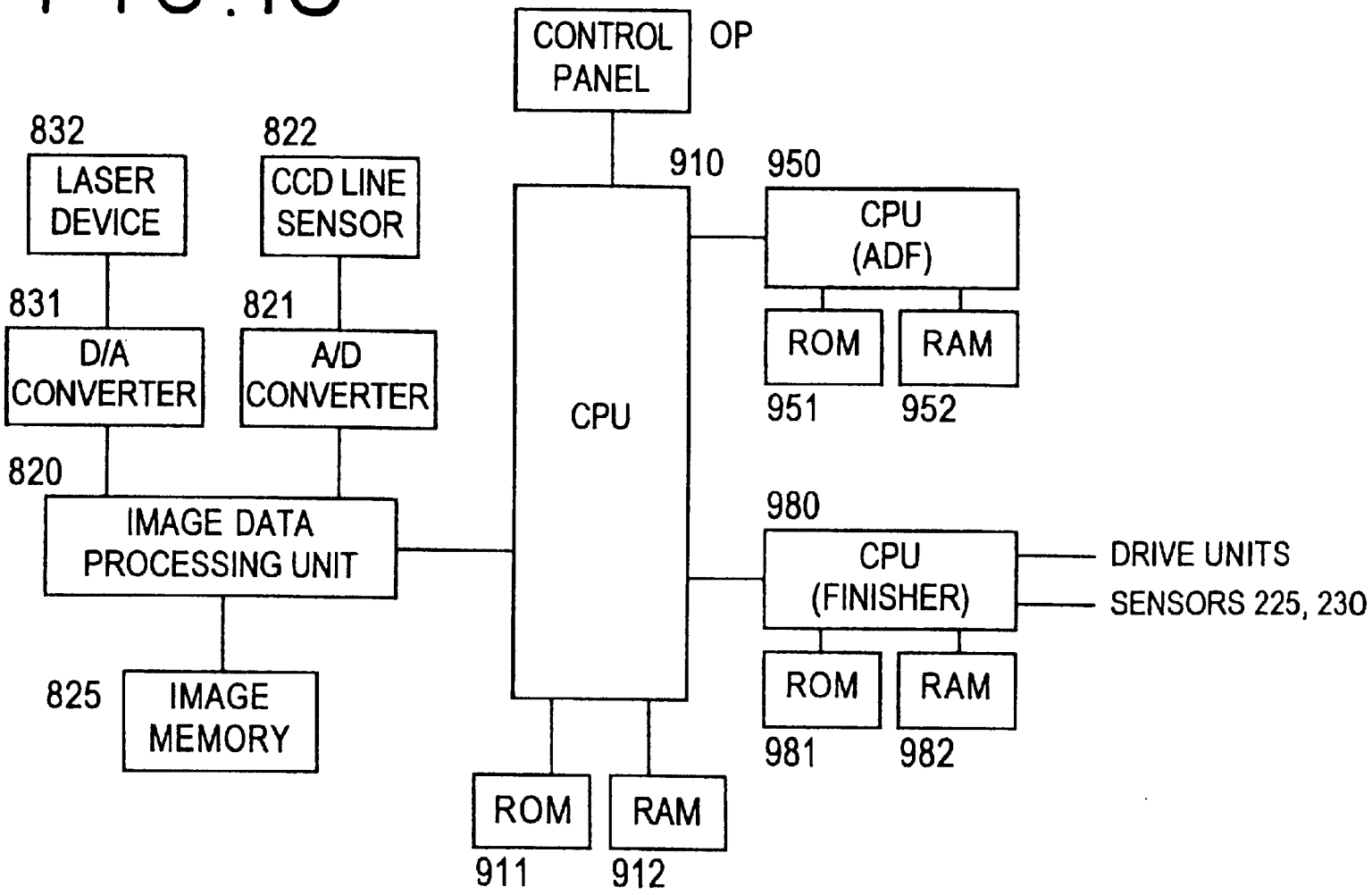
FIG. 18 is a block diagram of the construction of a control system which controls a copying machine and a finisher.

The system for controlling the various processing will be explained below. FIG. 18 is a block diagram of the control system for executing the various processing.

The control system is composed of a CPU 910 which controlling the copying machine, a CPU 950 which controls the ADF 12, and a CPU 980 which controls the finisher 100. These CPUs are provided respectively with ROM 911, 951 and 981, which store the control programs, and RAM 912, 952 and 982, which function as relevant working areas.

The CPU 910 for the copying machine is provided with an image memory 825 which stores a scanned image data and an image data processing unit 820 which executes such image processing as rotation, enlargement, and reduction of the image based on the image data stored in the image memory 825. A CCD line sensor 822 of the image reader is connected to the image data processing unit 820 through an A/D converter 821 which converts the scanned analog signal into a digital signal. Further, the image data processing unit 820 controls a laser device 832 of an image forming device (not shown) through a D/A converter 831 which converts a digital signal as a digital image data to an analog signal as an analog image data for outputting.

Various driven units and sensors are connected to the CPU 980 for the finisher for controlling and actuating the various units or devices of the finisher. The driven units include the motors and the solenoids. The sensors include the sheet sensor 225 provided in the conveying path and the home position sensor 230 provided in the folding section 254.

The ROM 981 connected to the CPU 980 for the finisher stores the number of sheets as thresholds for determining leading end bind and training end bind. The CPU 980 is constructed to be able to make a choice between the leading end bind and the trailing end bind in consideration of the following point. The deviation of sheets enlarges in proportion as the conveying distance increases (corresponding to in the trailing end bind mode) and the number of sheets of sheaf increases when rollers convey the sheaf. The sheaf continues to remain in the additional-work tray unit which is used for temporary storage during the stapling and thus the productivity in the leading end bind mode is lower than that in the trailing end bind mode. The present embodiment automatically makes the choice, depending on the question whether or not the number of sheets of sheaf is larger than the set value as the threshold. Of course, it may be constructed such that the user optionally makes the choice.

The CPU 910 for the copying machine calculates the number of output sheets besides the basic operations proper for a copying machine (such as reading an image data on a document, storing the image data in memory, editing or processing the image data, forming an edited image on a paper, and outputting the paper). Specifically, the CPU 910 controls the document feeding of the ADF 12, obtains the number of documents from the ADF 12, and calculates the number of output sheets based on the number of documents and the copy mode inputted through the control panel. The result of the calculation is inputted to the CPU 980 for the finisher. The CPU 980 effects the choice between the leading end bind and the trailing end bind. In case of the trailing end bind, the CPU 980 inputs an instruction for rotating an image to the CPU 910 for the copying machine. In the above manner, the leading end bind or the trailing end bind is automatically selected.

Figure 19:
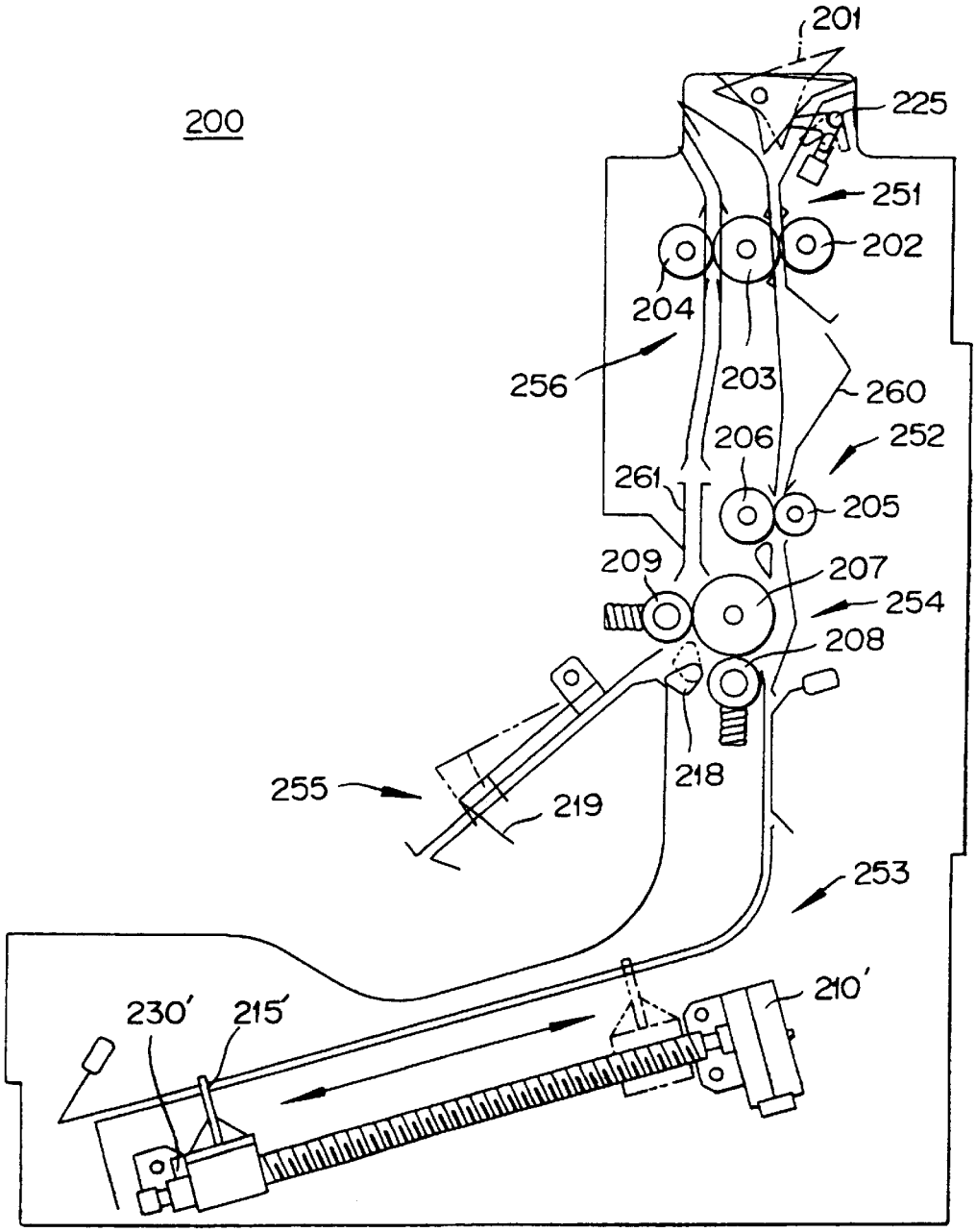
FIG. 19 is a cross-sectional view of the construction of a folding device provided with a first folding stopper according to another embodiment.

The present embodiment moves the first folding stoppers 215, 216, 217 forward and backward by means of the cam shaft 224. This invention is not limited to this particular embodiment. An embodiment in which a first stopper drive motor 210' moves a single folding stopper 215 instead of the first folding stoppers 215, 216 and 217 as illustrated in FIG. 19, is acceptable. In addition, the return of the first folding stopper 215' to the home position can be infallibly detected when a home position sensor 230' is so constructed as to detect directly the first folding stopper 215'. The embodiment calls for only a small number of components or devices and proves to be inexpensive as compared with the construction of the present embodiment. However, the construction has a disadvantage in requiring a long time for moving the stopper to the home position or for moving it from the home position to the position for regulating the sheet, and consequently failing to offer an expeditious additional-working. In contrast, the present embodiment in which the cam shaft 224 controls the forward or backward motion of the first folding stoppers 215, 216, 217, fits the expeditious additional-working.

It is obvious that this invention is not limited to the particular embodiments shown and described above but may be variously changed and modified by any person of ordinary skill in the art without departing from the technical concept of this invention.

The entire disclosure of Japanese Patent Application No. 09-058124 filed on Mar. 12, 1997, including the specification, claims, drawings and summary are incorporated herein by reference in its entirety.

What is claimed is:

1. A finisher connected to an image forming apparatus for applying various additional-workings to a sheet having an image formed surface outputted from said image forming apparatus, the finisher comprising:

a moving device which is movably mounted relative to a conveying path for applying an additional-working to said sheet, and a sensor for detecting said moving device at a home position, said home position being separated by a prescribed distance from said conveying path, said home position being a basis for controlling a position for said moving device, wherein said moving device, when a failure occurs inside, returns to said home position prior to a procedure of restoration from said failure.

2. A finisher according to claim 1, wherein said failure is a jam of said sheet.

3. A finisher according to claim 1, wherein said additional-working is a stapling.

4. A finisher according to claim 3, wherein said moving device is a stapler.

5. A finisher according to claim 3, wherein a plurality of positions of said sheet are stapled.

6. A finisher according to claim 1, wherein said additional-working is a folding.

7. A finisher according to claim 6, wherein said moving device is a folding stopper.

8. A finisher according to claim 1, wherein said moving device is a device for regulating a conveying direction of said sheet.

9. A finisher according to claim 1, wherein said sheet is stapled in a folded state.

10. A finisher according to claim 1, wherein said sheet is folded into two parts.

11. A finisher according to claim 1, wherein said sheet is folded into three parts or in a cross section like a letter Z.

12. A finisher according to claim 1, wherein said sheet is given a crease in a center part and said center part of said sheet is stapled.

13. A finisher according to claim 1, wherein a message for warning is outputted after said moving device has returned to said home position.

14. A finisher connected to an image forming apparatus for applying various additional-workings to a sheet having an image formed surface outputted from said image forming apparatus, the finisher comprising:

a moving device which is movably mounted relative to a conveying path for applying an additional-working to said sheet, and a sensor for detecting said moving device at a home position, said home position separated by a prescribed distance from said conveying path, said home position being a basis for controlling a position for said moving device, said moving device, when a failure occurs in said image forming apparatus, returns to said home position prior to a procedure of restoration from said failure.

15. A finisher according to claim 14, wherein said failure is a jam of said sheet.

16. A finisher according to claim 14, wherein said additional-working is a stapling.

17. A finisher according to claim 16, wherein said moving device is a stapler.

18. A finisher according to claim 16, wherein a plurality of positions of said sheet are stapled.

19. A finisher according to claim 14, wherein said additional-working is a folding.

20. A finisher according to claim 19, wherein said moving device is a folding stopper.

21. A finisher according to claim 14, wherein said moving device is a device for regulating a conveying direction of said sheet.

22. A finisher according to claim 14, wherein said sheet is stapled in a folded state.

23. A finisher according to claim 14, wherein said sheet is folded into two parts.

24. A finisher according to claim 14, wherein said sheet is folded into three parts or in a cross section like a letter Z.

25. A finisher according to claim 14, wherein said sheet is given a crease in a center part and said center part of said sheet is stapled.

26. A finisher according to claim 14, wherein a message for warning is outputted after said moving device has returned to said home position.

* * * * *